US008394461B2

(12) United States Patent
Komatsubara et al.

(10) Patent No.: US 8,394,461 B2
(45) Date of Patent: Mar. 12, 2013

(54) POWDER-CONTAINING OIL BASED MOLD LUBRICANT AND METHOD AND APPARATUS FOR APPLYING THE LUBRICANT

(75) Inventors: Hiroaki Komatsubara, Saitama (JP); Masanao Kobayashi, Gunma (JP); Toshiaki Shimizu, Saitama (JP); Daisuke Serino, Aichi (JP); Munenori Sugisawa, Aichi (JP); Tomiyuki Murayama, Aichi (JP); Noriaki Osawa, Aichi (JP); Tomohiro Yamaguchi, Aichi (JP); Ryujiro Aoki, Aichi (JP); Tatsuya Hattori, Aichi (JP)

(73) Assignees: Aoki Science Institute Co., Ltd., Tokyo (JP); Toyota Motor Corporation, Aichi (JP); Aisin Seiki Kabushiki Kaisha, Aichi-Ken (JP)

( * ) Notice: Subject to any disclaimer, the term of this patent is extended or adjusted under 35 U.S.C. 154(b) by 0 days.

(21) Appl. No.: 13/061,742

(22) PCT Filed: Sep. 25, 2009

(86) PCT No.: PCT/JP2009/004843
§ 371 (c)(1),
(2), (4) Date: Jun. 30, 2011

(87) PCT Pub. No.: WO2010/035468
PCT Pub. Date: Apr. 1, 2010

(65) Prior Publication Data

US 2011/0250363 A1 Oct. 13, 2011

(30) Foreign Application Priority Data

Sep. 26, 2008 (JP) ..... 2008-249147

(51) Int. Cl.
*B05D 1/04* (2006.01)
*B05B 5/025* (2006.01)
*C10M 169/04* (2006.01)

(52) U.S. Cl. ..... 427/486; 427/135; 427/483; 118/629; 308/154

(58) Field of Classification Search ..... 427/133, 427/483, 486; 118/629; 508/154
See application file for complete search history.

(56) References Cited

U.S. PATENT DOCUMENTS
(Continued)

FOREIGN PATENT DOCUMENTS

CN 101010156 8/2007
DE 42 12 667 A1 1/1993

(Continued)

OTHER PUBLICATIONS

Office Action issued with respect to patent family member Japanese Patent Application No. 2008-249147, mailed Jul. 3, 2012, and English-language translation thereof.

(Continued)

*Primary Examiner* — Frederick Parker
(74) *Attorney, Agent, or Firm* — Greenblum & Bernstein, P.L.C.

(57) ABSTRACT

A powder-containing oil-based lubricant for die contains 60 to 99% by mass of an oil-based lubricant consisting of oil, 0.3 to 30% by mass of a solubilizing agent, 0.3 to 15% by mass of an inorganic powder and 7.5% by mass or less of water, the lubricant being electrostatically applied to a die. The powder-containing oil-based lubricant may be applied to a die by electrostatic spraying. The electrostatic spray apparatus includes a device that imparts static electricity to the powder-containing oil-based lubricant and an electrostatic spray gun installed on a multi-axis robot.

3 Claims, 11 Drawing Sheets

U.S. PATENT DOCUMENTS

| | | | | |
|---|---|---|---|---|
| 5,266,229 | A | 11/1993 | Tomizawa et al. | |
| 5,682,591 | A * | 10/1997 | Inculet et al. | 419/38 |
| 6,902,758 | B2 * | 6/2005 | Donatti et al. | 427/133 |
| 2007/0131140 | A1 | 6/2007 | Aoki et al. | |
| 2009/0074981 | A1 | 3/2009 | Ohira et al. | |
| 2009/0118149 | A1 | 5/2009 | Ohira et al. | |

FOREIGN PATENT DOCUMENTS

| | | | |
|---|---|---|---|
| DE | 689 08 469 | T2 | 12/1993 |
| DE | 100 44 111 | A1 | 4/2002 |
| GB | 2257712 | | 1/1993 |
| JP | 60-001293 | | 1/1985 |
| JP | 01-299895 | | 12/1989 |
| JP | 02-160124 | | 6/1990 |
| JP | 5-17795 | | 1/1993 |
| JP | 5-17795 | A | 1/1993 |
| JP | 08-269474 | | 10/1996 |
| JP | 09-235496 | | 9/1997 |
| JP | 2000-153217 | | 6/2000 |
| JP | 2002-224783 | | 8/2002 |
| JP | 2006-150693 | | 6/2006 |
| JP | 2006-150693 | A | 6/2006 |
| JP | 2007-253204 | | 4/2007 |
| JP | 2007-211100 | | 8/2007 |
| JP | 2008-093722 | | 4/2008 |
| WO | 2006/025368 | | 3/2006 |
| WO | 2008/123031 | | 10/2008 |
| WO | 2008/123201 | | 10/2008 |

OTHER PUBLICATIONS

Search Report from E.P.O. issued with respect to European Patent Application No. 09811589.0, mailed Apr. 18, 2012.

China Office action, dated Nov. 05, 2012 along with an english translation thereof.

* cited by examiner (A)

(B)

POWDER-CONTAINING OIL BASED MOLD LUBRICANT AND METHOD AND APPARATUS FOR APPLYING THE LUBRICANT

BACKGROUND OF THE INVENTION

1. Field of the Invention

The present invention relates to a powder-containing oil type lubricant applied for a die in the casting or forging processing of non-ferrous metals such as aluminum, magnesium and zinc, and to an electrostatic spray method and to an electrostatic spray apparatus using the powder-containing oil type lubricant.

2. Description of the Related Art

As is well known, the process using a die in the processing of non-ferrous metals involves methods including casting, forging, press working and extrusion casting. As viewed from the process, the casting is largely classified into high-pressure die casting, gravity die casting, low-pressure die casting, squeeze die casting and the forging is largely classified into cold forging and hot forging. Further, as viewed from the material to be the subject of the process, the material is largely classified into iron, non-ferrous metals and plastics. As viewed from the lubricant to be applied to the surface of a die, the lubricant is largely classified into a water based lubricant and an oil type lubricant, and the water-based lubricant is classified into a transparent solution type and a milky opaque emulsion type. As viewed from the components contained in the lubricant, the lubricant may be classified into a type containing a powder and a type containing no powder. As viewed from the spray method, it is largely classified into brush coating, liquid droplet coating and spray coating. The spray coating may be classified into combinations of a binary-fluid system and single-fluid system, and a non-electrostatic type and electrostatic type.

The high-pressure die casting, gravity die casting and low-pressure die casting are similar to each other in basic process. These processes are often likened to the process making an omelet by applying oil to a flying pan and by pouring a fresh egg into the flying pan. Specifically, when a non-ferrous metal is cast, a lubricant (corresponding to the cooking oil) is applied to the die (corresponding to the flying pan) to prevent the molten metal (corresponding to the stirred fresh egg) from sticking to the die. Then, dissolved molten metal at a high-temperature is poured in the die and solidified and then, the product (corresponding to an omelet) is taken out of the die. When viewing from the production efficiency and strength quality of the product in this case, the high-pressure die casting produces a low strength product with a high production efficiency, the gravity die casting produces a high strength product with a low production efficiency, and the low-pressure die casting produces a product having a strength closer to that of the gravity die casting than to that of the high-pressure die casting with a production efficiency closer to that of the gravity die casting than to that the high-pressure die casting. As products having the possibility of a danger to life caused by the breakage of parts, it is inevitable to produce those having high strength even with the low production efficiency. In the case of parts independent of life even if they are broken, the efficiency of production is regarded as important even if air is entrained to a form sponged part of which strength are reduced. Specifically, a main difference between these production methods is due to a difference in the rate of filling the molten metal in the die, and the filling rate is higher in the order of the gravity die casting, low-pressure die casting and high-pressure die casting. For this, the quantity of heat transferred to the coated film formed in the die is different depending on the casting method: the largest heat is transferred in the case of the gravity die casting and the smallest heat is transferred in the case of the high-pressure die casting. There is the case where the lubricant is decomposed or vanished corresponding to the transferred heat quantity and different lubricating technologies are applied to the die at present.

The forging process, on the other hand, is often likened to the process of producing a sword and is a method for raising the strength of the sword by beating a solidified metal. Namely, this process is also a method in which a solidified metal is beaten by high pressure to produce a desired shape. Though the time during which the coated film is exposed to a high-temperature environment is short, the coated film is exposed to very high-pressure. Accordingly, the lubricating technology is considerably different from that of the present casting process It is difficult to satisfy all these requirements for the combinations of various classifications by one lubricant and therefore, individual technologies are applied to each use. However, lubrication technologies considering combinations of two or more of these classifications are possible. The present application relates to lubricating technologies aiming at the integration of these plural technologies and these lubrication technologies will be explained in the order of those for the high-pressure die casting, gravity die casting, low-pressure die casting and forging.

A) High-Pressure Die Casting

Seeing into this fields, 90% or more of the lubricants for non-ferrous metals such as aluminum, magnesium and zinc are water-based type releasing agents for the last forty years. Water-based releasing agents obtained by emulsifying effective components in water are applied to a die by the binary-fluid spray system mainly using pneumatic pressure. Electrostatic spray technologies have not been applied to water-based releasing agents due to excessively high electroconductivity at all.

Oil type releasing agents have come to be used which enables casting even if each of the releasing agent is used in an amount as small as 1/500 to 1/1000 that of the water-based releasing agent to be used from several years ago. However, the oil type lubricant can be applied only in a small amount and there is therefore the case where the coated film in a die, having a complicated structure or a large size and particularly at die positions hidden from the spray surface, may be insufficiently formed. In addition, because the die has surface irregularities, there is a tendency that a thick spray film is formed in the concave portion whereas a thin coated film is formed in the convex portion. For this, there is a tendency that oil type lubricant components are excessively retained causing an increase in casting porosity (sponging) in the concave portion, whereas the lubricity is insufficient, causing the seizure and soldering of the casting product with the die in the convex portion. As measures taken currently in the production site, the amount of the oil type lubricant is increased such that sprayed mists to be reached the hidden parts and the convex portion as much as possible to cast at a sacrifice of a small increase in casting porosity. Further, in the case of a large size die, the thermal energy of a molten metal of a non-ferrous metal is large. Therefore, the temperature of the whole die and particularly, the temperatures of narrow parts become close to the temperature of the molten metal and sometimes become 350° C. or more. For this, the oil type lubricant shows a "Lidenfrost" phenomenon and sprayed oil mists on the die surface boil. This causes the oil type lubricant to be deteriorated in the wettability of the surface of the die. Specifically, the boiling causes an increase in liquid droplets scattered on the floor from the surface of the die. As a result, t the coated film may become thin, bringing about deteriorated lubricity.

The measures taken in the case of the water-based release agent, it is applied in a large amount to cool the die surface, thereby sticking the release agent at a temperature less than the Leiden-frost temperature. This naturally causes a waste water problem. Two kinds of method are adopted as the measures taken in the case of an oil type lubricant. In one of these methods, a little more lubricant is applied to thicken the coated film. In the other, a small amount of water is applied so that almost all the water can be vaporized for cooling high-temperature narrow parts and then, the oil type lubricant is applied. If a little more oil type lubricant is applied, the thickness of the coated film at the parts, where a sufficient coated film can be formed, is increased as well. As a result, the amount of the casting porosity tends to increase. Because of this, the strength of the casing product is weakened a little. Besides, even though the amount of water is small, a pipe for coating is required.

Specifically, the prior art has the following problems.

(1) The oil type lubricant is insufficiently supplied to hidden parts of the die and it is therefore difficult to form a coated film necessary for lubrication at these parts.

(2) It is difficult to form a coated film having a satisfactory thickness at narrow parts of the die.

(3) It is difficult to form a uniform spray film at irregular parts of the die.

Electrostatic spraying is effective means to solve these problems concerning the oil type lubricants. In a spray apparatus, oil droplets of the oil type lubricant are negatively charged and sprayed to the positively charged die surface. The electrostatic spraying is the technology enabling the sprayed lubricant oil droplets to reach hidden parts of the die. However, electrostatic spraying cannot be applied in the case of a water-based release agent since it has excessively high electroconductivity. Japanese patent Application Laid-open (JP-A) No. 9-235496 relates to technologies used as the measures taken to impart conductivity to a paint to thereby drop the electric resistance by adding an alcohol or ammonium salt as an electrostatic assistant agent. However, alcohol or ammonium mists are not preferable at the casting site. JP-A No. 2000-153217 relates to technologies which hint the addition of an electrostatic assistant agent to a paint. However, "an electrostatic assistant agent having high polarity" is dissolved only in an amount of 0.3% by mass in "an oil type lubricant having low polarity", and an electrostatic assistant agent tends to cause sedimentation and separation, which is not preferable. The present inventors have made studies concerning this problem, and as a result, found that at this level, the electrostatic assistant agent does not affect on the increase of adhesion amount of coated film. If a polar solvent is added, the dissolution of the electrostatic assistant agent may be increasingly solved. However, the health of a site worker may be damaged because of the polar solvent. For this, polar solvents are not preferable in the composition of the oil type lubricant in consideration of human health.

In order to solve the additional problems according to the electrostatic spraying as mentioned above, the present inventors have proposed such a technology that water and a solubilizing agent are blended in an oil type lubricant to impart slight conductivity for electrostatical spraying in the case of a high-pressure die casting. However, the technology tends to scarcely cope with the soldering caused by the deficiency of cooling ability originated from the very small amount of the lubricant to be applied.

(B) Gravity and Low-Pressure Die Castings

The flow speed of the molten metal during casting is an important factor for a coated film in casting. If the flow speed of the molten metal is extremely low similarly to the case of gravity die casting, the time during which the coated film is in contact with a molten metal having a temperature as high as about 600° C. is long, so that the coated film is significantly deteriorated. As a result, the coated film is thinned and there is therefore the case where the molten metal is stuck to the die surface when it is solidified. Therefore, the so-called "mold wash" prepared by suspending inorganic powders in water is mainly used at present in order not to be affected by the thermal deterioration. A coated film of the mold wash consists of inorganic powders and is not deteriorated. However, this needs drying because the mold wash contains water. Metaphorically expressing, this process corresponds to the plastering process used for Japanese houses and long-time drying is required. In the case of casting, molten aluminum and water give rise to steam explosion when the molten metal is poured into the die before the mold wash is completely dried up. For this, it is essential to carry out a drying process for several hours after the spraying is finished and this series of operation "spraying, drying and producing in each casting" extremely reduces production efficiency. In light of this, "the mold wash is sprayed once every tens or hundred and tens of products" to minimize the drying process at present. Further, the mold wash is considered as a craftsman technique and a skilled craftsman can produce 100 or more products per one time coating. An unskilled craftsman can sometimes produce only 10 products at most. Further, there is the case where a thick coated film made using the mold wash is partially peeled off. The peeled powder gets mixed in the casting product and extremely reduces the strength of the casting product. Because it is unclear when the peeling occurs, all casting products in the lot containing the peeled product is regarded as rejected goods and withdrawn from customers. Further, in view of product appearance, if the coated film is peeled off, the peeled part forms convexity, exhibiting inferior appearance.

In the casting process, it is important not only to prevent soldering but also to keep a perfect flow so that the molten metal can reach to finely engraved cavity parts of the die to make a product having a desired finish. In order to secure this molten metal flow, a thick coated film is formed. Specifically, it is so designed that the cooling of the molten metal is retarded and the viscosity of the molten metal is kept low for giving a good flow of the molten metal to fine parts of the die. Though the mold wash is applied once every tens of casting operations as mentioned above to secure a thick coated film (tens to hundred and tens of micrometers), a small amount of powder is intermingled in the casted product in each casting operation. For this, the coated film is gradually thinned, leading to reduced insulating efficiency. Finally, the temperature of the molten metal is dropped, and therefore, the flow of the molten metal cannot be secured, with the result that the flow of the molten metal into all parts of the die is inhibited. Namely, this metaphorically corresponds to the production of an omelet which loses its shape. The coated film is thick in its initial stage and is thin after tens of castings are finished. Therefore, the cooling rate of an initial product is different from that of a product obtained after tens of casting operations. As a result, the crystal structures of the metal are different from each other, bringing about the drawback that there is a difference in quality between a product obtained in the initial stage of the spraying and a product obtained in the later stage. Specifically for stabilizing the quality of a casting product, frequent spraying is required, but frequent drying is also required. This leads to reduced production efficiency. A thick coating film is formed in the first stage and is used until the lubricity is deteriorated to thereby decrease the number of inefficient drying steps at a sacrifice of stable product qualities.

Moreover, in the case of powder rich coated film, a casted product generally has a satin finished surface, which may fail to satisfy the requirement of quality of appearance depending on the product and it is therefore necessary to carry out after-treatment with the view of giving glossiness. In addition, the scattering of the powder after dried cannot be avoided because 100% (excluding the amount of water) of the powder is used, and it is necessary to take care of the working environment.

The technologies described in JP-A No. 2007-253204 and JP-A No. 2008-93722 are known as the technologies that compensate such a drawback. Both technologies relate to an oil type lubricant containing no water to remarkably reduce drying time. Further, the number of sprayings is increased to avoid excessively thick coated film, thereby forming a more uniform coated film than in the case of the usual mold wash. Moreover, the content of powders is reduced to make a film as thin as possible to prevent the peeling of the film. Further, this oil type lubricant contains a low-concentration powders and therefore, the scattering of the powders at production site is limited to minimum.

(C) Forging

The forging is a measures for compressing a metal material to be made into a product by deformation. This measures is largely classified into free forging and die forging. A sword made by beating an iron material without using any mold is a good example of the free forging. On the other hand, forging while making a uniform product using a mold is the die forging. The crank shaft of an engine part is a good example of the die forging. There is also the case where a material to be forged (hereinafter referred to as a work") is heated to soften the material, thereby reducing the compressive force required for deformation. The heating temperature differs depending on the work material. Although the forging is usually classified into cold forging, warm forging and hot forging by the degree of heating, it is not clearly divided by numerical value.

The cold forging is carried out at a temperature (usually, ambient temperature) lower than the recrystallization temperature of the work material and has high dimensional accuracy. Therefore, many products can be developed without any after-treatment. The cold forging is suitable to small-sized products. On the other hand, the hot forging is carried out at a temperature higher than the recrystallization temperature and is applied to large-sized products. However, an oxide film is formed on the surface of the work and therefore, the crack of a product is easily caused. Further, the work is compressed under high pressure to deform. In the condition that no lubricant is present between the work and the die, scratching and soldering are caused between the work and the die under the high pressure. Therefore, a lubricant is applied to the die to prevent scratching and soldering.

Generally, a coated film is easily formed by physical adhesion in the cold forging. In the hot forging performed at high temperatures, on the other hand, the Leidenfrost phenomenon occurs at high temperatures and therefore, lubricant components are scarcely adhered to the die. Further, even if the lubricant components are adhered to the die, physical adhesion power between the both is low and it is difficult to form a good coated film. In the case of a lubrication using water as a medium, water can not be vaporized at 100° C. or less and no lubrication is therefore made; however, a coated film is easily formed at an intermediate temperature. However, if the temperature exceeds 240° C., a coated film is scarcely formed because of the Leidenfrost phenomenon.

As commercially available materials used to form the coated film, the following structures may be exemplified.

1) Graphite type: two types of lubricants, that is, a W/O emulsion type and oil dispersion type.

2) White powder type: W/O emulsion type of mica, boron nitride or melamine cyanurate.

3) Glass type: a mixture system of colloidal silicate and an alkali metal salt of an aromatic carboxylic acid (JP-A No. 60-1293) and a type which is used by diluting it in water.

4) Water-soluble polymer type: contains water (JP-A No. 1-299895)

Graphite exhibits excellent lubricity at temperatures ranging from a low temperature to a high temperature. However, in the case of graphite, the working circumstance is contaminated with a black powder and is inferior. Particularly, a lubricant of the type obtained by mixing graphite in oil is a cause of significant contamination. A lubricant mainly containing a white powder impairs the working circumstance not so much as graphite. However, if the content of the white powder is large, the working circumstance is also deteriorated. Further, the white powder is inferior in lubricity to graphite. In addition, there is the case where the white powder has a high hardness property, and there is therefore a tendency that the white powder damages the surface of the die to thereby shorten the life of the die.

Although a glass type or polymer type lubricant enables the formation of a thick film, it is inferior in lubricity to graphite and more reduces the life of the die than graphite. Further, the glass lubricant forms a glass film or polymer film around the equipment and periodical cleaning working is required though the frequency of the cleaning is not so much as in the case of a white powder, bringing about low working efficiency.

These graphite and white powder type lubricants are always concerned with the problem as to the occurrence of separation when they are stored and clogging of pipes and spray nozzles since these lubricants contain dispersed powders in water or oil. The water-glass type is dried in the vicinity of the nozzle. Particularly, when the working is suspended for a long time, the drying is promoted, causing clogging of the tip of the nozzle. As a result, when the working is restarted, the amount to be sprayed is reduced. Accordingly, the lubricating ability becomes insufficient, leading to the production of defectives. Though the W/O emulsion type lubricant is superior in the ability to cool the die, waste water treatment is necessary.

Further, when the surface of the die exceeds 230° C., mists of the lubricant embraced in water are boiled on the surface of the die. As a result, the adhesive efficiency of the lubricant to the die is impaired and it is therefore necessary to apply the lubricant in a large amount. Specifically, it is essential to severely control the temperature of the die because the formation of the coated film from the water-based lubricant is largely dependent on the temperature. Since water is scarcely vaporized at 100° C. or less, an emulsion type lubricant is unsuitable to cold forging. On the other hand, the emulsion type lubricant is used in warm or hot forging. However, water cools the die and the work to be forged heats the die. If this heating-cooling cycle is repeated, cracks are generated on the die surface. It is necessary to repair the die and in addition, an increase in the number of repairs results in the dumping of the die. That is, water shortens the life of the die. Further, when a drop in the temperature of the work in the molding process is significant, it is necessary to carry out molding under a heavy load, which is cause of shortened die life.

With regard to the method of spraying the lubricant, there is the problem that if the lubricant is applied in a large amount, the cycle time (the working time for producing one product) is prolonged. In the case of a water-based lubricant, the lubricant is applied in a large amount, which is not preferable in view of production efficiency. Further, there are problems concerning deteriorations in working circumstance caused by the scattering of the lubricant which is sprayed a large amount of the lubricant and concerning an increase of the frequency of the supplement of the lubricant for production. Moreover, there is the case where the heating process of work brings about a reduction in productivity. The production process using a conventional water-soluble lubricant is diversified after the temperature of the work is raised and the subsequent process involves, for example, pre-molding, course molding and finish molding. At this time, a resistance to deformation is increased, making it difficult to mold because the temperature of the work is dropped with the progress of the molding process. In the case of, particularly, a water-soluble lubricant, the amount of the lubricant to be applied becomes large, so that the die is cooled to accelerate a drop in temperature. To cope with this problem, there is the case of adding a reheating process. However, this reheating process causes an increase in cycle time, space and running cost, resulting in reduced production efficiency.

In order to solve the problems, the present inventors have proposed an oil type lubricant containing a low-concentration powder. It includes no water because the lubricant is oil type, and therefore the reduction in the deterioration of productivity and increase in production cost caused by water can be prevented. Further, because the concentration of the powder is low, the deterioration in site circumstance and the problem concerning sedimentation, when the lubricant is stored, can be reduced. Moreover, the cooling ability is small because the lubricant is applied in a small amount, so that the reheating process can be eliminated, exhibiting high production efficiency. However, scratching or soldering is caused under a heavy load though depending on the conditions.

In individual cases, prior art is established to some extent. However, the lubricating technologies which are common to the high-pressure casting, gravity casting, low-pressure casting and forging nowhere are disclosed.

SUMMARY OF THE INVENTION

The object of the present invention is to provide an oil type lubricant composition containing a powder to preventing soldering particularly at a high-temperature part under a heavy load by electrostatically applying the lubricant to a die for high-pressure die casting, gravity die casting, low-pressure die casting and forging, a spray method of spraying the composition and a spray apparatus of spraying the composition.

The first aspect of the present invention relates to a powder-containing oil type lubricant, which consists of 60 to 99% by mass of an oil type lubricant for die casting, 0.3 to 30% by mass of a solubilizing agent consisting of oil, 0.3 to 15% by mass of inorganic powders and 7.5% by mass or less of water, and which is electrostatically applied to a die, or to a powder-containing oil type lubricant, which consists of 60 to 98.7% by mass of an oil type lubricant for die casting, 0.8 to 30% by mass of solubilizing agents, 0.3 to 15% by mass of inorganic powders and 0.2 to 7.5% by mass of water, and which is electrostatically applied to a die.

Further, the second aspect of the present invention relates to an electrostatic spray method of electrostatically applying the powder-containing oil type lubricant to a die surface.

Further, the third aspect of the present invention relates an electrostatic spray apparatus of electrostatically applying the powder-containing lubricant to a die, the apparatus being provided with a static electricity-imparting apparatus that imparts static electricity to the powder-containing oil type lubricant and an electrostatic spray gun disposed on a multi-axle robot.

According to the present invention, soldering of parts hidden from the spray apparatus and high-temperature parts particularly under a heavy load can be prevented when the oil type lubricant is applied to a die for high-pressure die casting, gravity die casting and low-pressure die casting and forging.

BRIEF DESCRIPTION OF THE DRAWINGS

FIG. 3A is a view for explaining the situation where a lubricant is applied to a test piece. FIG. 3B is a view for explaining the situation where dissolved aluminum is solidified on a test piece sprayed with a lubricant and then, the frictional force is measured.

FIG. 7A shows the side surface of the lid and FIG. 7B is a view showing the backside of the lid.

FIG. 8A shows the measure used in the molten metal flow test and FIG. 8B shows the bar used in the molten metal flow test.

DETAILED DESCRIPTION OF THE INVENTION

Figure 1:
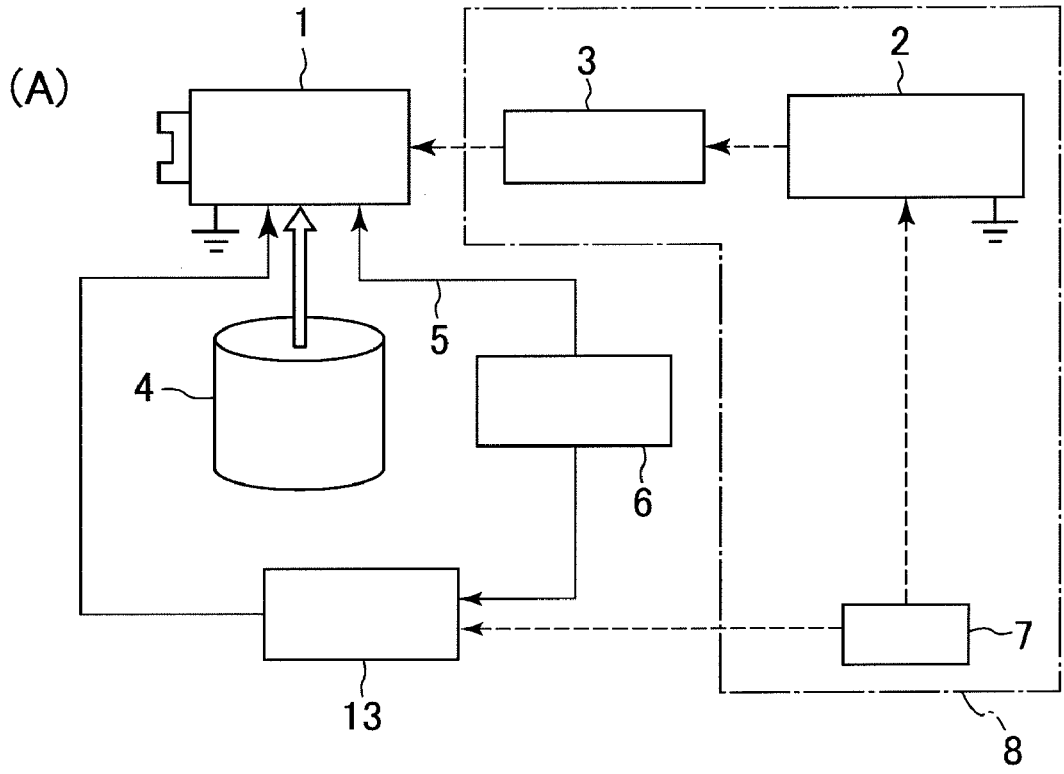
FIG. 1A is a schematically explanatory view showing the whole electrostatic spray apparatus according to the present invention. Further.
FIG. 1B is a view for explaining the situation where an oil type lubricant is applied to a die from an electrostatic spray gun which is a part of the electrostatic spray apparatus of FIG. 1A and is disposed on a multi-axle robot.
Figure 1:
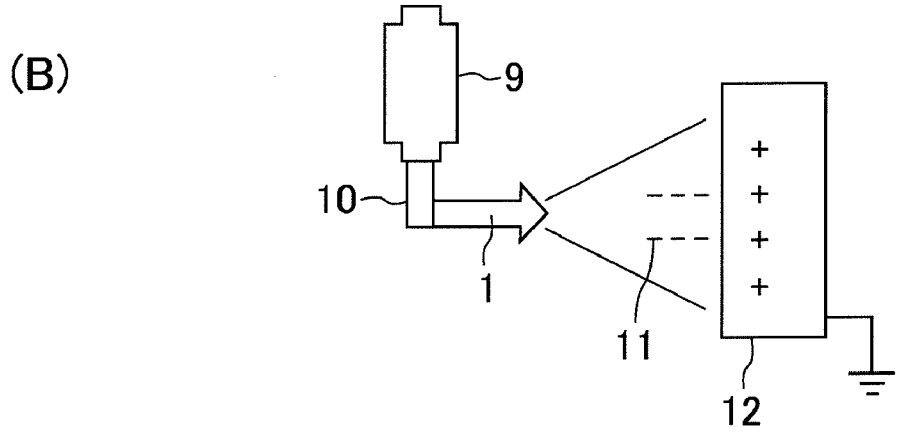

The first aspect of the present invention will be explained in more detail below.

a) Oil Type Lubricant

The oil type lubricant used in the first aspect of the present invention is made from oil, which is not mixed with water in the absence of a surfactant or a solubilizing agent as mentioned later, has a low polarity and is a flammable liquid at normal temperature. The oil type lubricant is preferably made from a petroleum type saturated hydrocarbon component (solvent or mineral oil and synthetic oil), lubricity improving components (lubricating additive such as silicone oil, animal or vegetable oil and fatty acid ester) to improve lubricity and high-viscosity petroleum type hydrocarbon oil components for keeping a coated film. Examples of the oil type lubricant include those described in the publication of WO2006/025368 and release lubricant agents conventionally called "startup agents".

The amount of the oil type lubricant is 60 to 99% by mass in the powder-containing oil type lubricant of the present invention. The amount of the oil type lubricant is preferably 60 to 98.7% by mass and more preferably 70 to 90% by mass in the powder-containing oil type lubricant of the present invention. If the amount is less than 60% by mass, the drying ability of the oil type lubricant on the surface of a die is impaired, whereas if the amount exceeds 99% by mass, the coated film on the surface of the die becomes thin and the lubricity tends to be weak.

As the petroleum type saturated hydrocarbon component, a solvent, or mineral oil and synthetic oil are preferably used as a main component. These components are mixtures of tens to thousands of compounds, and called solvents when they have low boiling points and mineral oils or synthetic oils when they have high boiling points. However, there is no clear classification between these compounds. Usually, these compounds are classified not by boiling point but by flash point which is an index to volatility. The solvent is, quite naturally, regarded as a compound having a flash point of about 150° C. or less and the mineral oil or synthetic oil is regarded as a compound having a flash point of 200° C. or more. A compound having a flash point range between the flash points (150 to 200° C.) is called a solvent or mineral oil as the case may be. If the flash point of the oil type lubricant is low, it has good drying characteristics and forms a firm coated film. However, a danger of ignition is heightened and the film thickness is thinned. If the flash point of the oil type lubricant is high on the other hand, a danger of ignition is lowered. However, the drying ability is deteriorated and the coated film is apparently thick, but excess parts of the film increases and drops out of the coated film by heat. This portion tends to be resultantly a cause of porosity in a cast product. The flash point of the petroleum type saturated hydrocarbon in the powder-containing lubricant of the present invention is preferably in a range from 70 to 250° C. Further, the high-viscosity petroleum hydrocarbon works as a binder for retaining the coated film, its dosage is several percentages (%), and preferably has a flash point (low volatility) of 250° C. or more. When the flash point is less than 70° C., this petroleum type is classified into the Second Class Petroleum in Japan having a high danger of fire and is therefore not preferable.

Examples of the solvent of the petroleum type saturated hydrocarbon components include hydrocarbons having 10 or more carbon atoms which are liquids at normal temperature. Specific examples of the solvent include decane, dodecane, octadecane and petroleum type solvents having 15 carbon atoms. Among these compounds, petroleum type hydrocarbons having 14 to 16 carbon atoms are preferable from the viewpoint of a danger of fire and drying ability on the surface of a die. Examples of the mineral oil of the petroleum type saturated hydrocarbon components include spindle oil, machine oil, motor oil and cylinder oil. Examples of the synthetic oils of the petroleum type saturated hydrocarbon component include poly-α-olefins (for example, an ethylene/propylene copolymer, polybutene, 1-octene oligomer, 1-decene oligomer, and hydrides of these compounds), monoesters (for example, butyl stearate, and octyl laurate), diesters (for example, ditridecyl glutarate, di-2-ethylhexyl adipate, diisodecyl adipate, ditridecyl adipate, and di-2-ethylhexyl sebacate), polyesters (for example, trimellitate), polyol esters (for example, trimethylolpropane caprylate, trimethylolpropane pelargonate, pentaerythritol-2-ethyl hexanoate and pentaerythritol pelargonate), polyoxyalkylene glycol, polyphenyl ether, dialkyl diphenyl ether and phosphates (for example, tricresyl phosphate).

Examples of the lubricity improving components include fatty acids, organic acids, alcohols and silicone. Examples of the fatty acid components include vegetable oils such as rape seed oil, soybean oil, coconut oil and palm oil. Further, examples of the organic acid include oleic acid, stearic acid, palmitic acid, lauric acid and besides, monohydric alcohol esters of higher fatty acids such as tallow fatty acid. Examples of the alcohol include polyhydric alcohol esters. Examples of the silicone oil component include dimethyl silicone and alkyl-modified silicone. Among these compounds, rape seed oil and alkyl-modified silicone are preferable from the viewpoint of lubricity at high temperatures. In the oil type lubricant, these compounds may be used either singly or in combinations of two or more.

(b) Solubilizing Agents

In the present invention, the solubilizing agents are compounds which solubilize water and are also dissolved in an oil type lubricant having a low polarity. Examples of the solubilizing agents include solvents such as alcohols, glycols, esters, ethers, and ketones or emulsifiers. If these solvents in which water is dissolved are not dissolved further in the oil type lubricant, there is the case where water is separated from a part of the solvent to make the solution cloudy. As a result, the electric resistance becomes infinite. Though lower (C1 or C2) alcohols and glycols dissolve much water, they tend to be separated in a petroleum oil type lubricant. Further, low toxicity and low polarity which have less influence on the health of operators are characteristics required for the solvent because the oil type lubricant is used with applying it. Almost odorless properties are also important. As compared with volatile ethers, ketones, lower (for example, C3, C4 or C5) alcohols and esters, nonionic or anionic emulsifiers having both hydrophilic and hydrophobic groups are most preferable as the solubilizing agent in order to dissolve water in an oil type lubricant having a low polarity taking these points into account.

Solubilizing agents having an HLB (Hydrophile-Lipophile Balance) range from 5 to 10 are most preferable from the viewpoint of solubilizing ability. If the HLB is lower than 5, it is difficult to solubilize water but the solubilizing agent is easily dissolved in oil. Therefore, in order to dissolve a fixed amount of water in the oil type lubricant, a large amount of solubilizing agent is required. When the HLB exceeds 10, the solubilizing agent easily solubilizes water but is scarcely dissolved in oil. Therefore, when it is intended to dissolve a fixed amount of water in the oil type lubricant, the both is separated. As an adequate solubilizing agent, those having a proper range of HLB are most preferable. As the emulsifier, a nonionic type sorbitan is superior to a phenol/ether type having a problem concerning an environmental hormone because the nonionic sorbitan is free from such a problem.

When the solubilizing agents are mixed, there are concerns that the lubricity intrinsic to the oil type lubricant is inhibited and the generation of porosity in the cast product is increased. To limit the occurrence of these possible problems to minimum, it is important to limit the amount of the solubilizing agents to be compounded to a low level. The amount of the solubilizing agent is preferably less than nine times the content of water. The amount of the solubilizing agents is 0.3 to 30% by mass in the powder-containing oil type lubricant. When the amount of the solubilizing agents is less than 0.3% by mass, there is a tendency that the solubilizing agents fail to solubilize water to have the problem that water is separated from other components, whereas when the amount of the solubilizing agents exceeds 30% by mass, there is a tendency that the solubilizing agents are themselves separated from other components. The amount of the solubilizing agents is preferably 0.8 to 30% by mass.

(c) Inorganic Powder

The aforementioned components including the oil type lubricant, water and solubilizing agent are decomposed/evaporated in several seconds at a temperature range exceeding 400° C. Though a part of these components retain lubricity even if they are decomposed, the coated film is thin, resulting in reduced insulation ability. If the coated film becomes thin, the die is brought into direct contact with the molten metal, resulting in soldering. Further, when the insulation ability is reduced, the temperature of the molten metal is dropped, leading to an increase in the viscosity of the molten metal. As a result, the molten aluminum is not flowed into all corners of the die cavity and therefore, a product having a desired form cannot be obtained. In the case of forging, on the other hand, the temperature of the work is dropped with reduction in insulation ability, so that the work is hardened. As a result, larger power is required to deform the work. As will be mentioned later in the examples, it has been confirmed that inorganic powders are resistant to deterioration at high temperatures and maintain a thick coated film to exhibit insulation ability. Specifically, the inorganic powders have effects on the prevention of soldering in the casting and on the prevention of soldering and a reduction in work deformation pressure in the forging.

Examples of the inorganic powders include talc, mica, clay, silica, refractory mortar, boronnite, fluororesin, sericite, borate, alumina powder, pyrophosphate, sodium bicarbonate, titanium oxide, iron oxide red, radiorite, zirconium oxide, graphite and carbon black. Among these materials, a clay powder with an organic material adsorbed thereto is the most preferable to impart a precipitation resistance to the powder in oil. Further, calcium carbonate which has a relatively low specific gravity and is relatively resistant to precipitation is preferable. The amount of the inorganic powder to be formulated is 0.3 to 15% by mass and preferably 1 to 10% by mass. When the amount of the inorganic powder exceeds 15% by mass, this causes the problem that the inorganic powder is precipitated before the oil type lubricant is used in the case that the oil type lubricant is stored for a long period of time after the oil type lubricant is produced. Further, the surfaces of the cast product and work are scratched, leading to impaired surface gloss. Further, the working site is contaminated with the powder. When the amount of the inorganic powder is less than 0.3% by mass, the effect of preventing soldering at high temperatures is reduced.

(d) Water

The electric resistance of the oil type lubricant mentioned in the above (a) is infinite and therefore, the oil type lubricant is unsuitable to the electrostatic spraying. However, the electrostatic spraying is made possible by adjusting the electric resistance of the oil type lubricant to 5 to 400 MΩ. For example, when 0.8% by mass of water is dissolved in the oil type lubricant by the aid of solubilizing agents, the electric resistance is dropped to about 20 MΩ. Though detailed test results will be mentioned later, water is added in an amount of 0 to 7.5% by mass in the powder-containing oil type lubricant of the present invention. It is more preferable to add water in an amount of 0.2 to 7.5% by mass in the powder-containing oil type lubricant of the present invention. When the amount of water exceeds 7.5% by mass, water is separated from the oil type lubricant, leading to the denaturing of the reserved lubricant. On the other hand, even in the case where the content of water is 0% by mass, a resistance meter operated under a voltage as low as 1.5 V indicates infinite electric resistance. However, a polar component such as a lubricity improver in the oil type lubricant exhibits a slight electrostatic effect under high voltage (60 KV) electrostatic spray condition. In Table 2 which will be mentioned later, the electric resistance is dropped to 1500 MΩ from the infinity when 0.1% by mass of water is added and to 900 MΩ when 0.4% by mass of water is added. If the amount of water is less than 0.2% by mass, the degree of a reduction in electric resistance tends to be lowered.

e) Lubricant Composition

With regard to the preferable range as to the composition of the oil type lubricant, it is necessary to consider the time during which the oil type lubricant is in contact with a high-temperature die surface and molten metal, pressure in the production, skin gloss of a casted product and necessity of the precipitation prevention of powders in the oil type lubricant. In the high-pressure casting in which the time during which the oil type lubricant is contact with a high-temperature die or molten metal is shorter and a device for stirring the oil type lubricant is scarcely provided, it is preferable to limit the amount of inorganic powders to somewhat low level and specifically to 1 to 5% by mass. In the gravity/low-pressure casting in which the time during which the oil type lubricant is contact with a high-temperature mold or molten metal is longer and it is common practice to stir the oil type lubricant, the inorganic powder can be designed to be compounded in a high concentration. In this case, the amount of the inorganic powders is preferably 5 to 15% by mass. In the case of the forging operated at extremely-high pressure, the amount of the inorganic powder is preferably 3 to 7% by mass taking the soldering of a product into account.

When the powder-containing oil type lubricant of the present invention is used in the gravity casting or low-pressure casting, it is preferably constituted of 80 to 90% by mass of the oil type lubricant, 0.8 to 4% by mass of the solubilizing agents, 5 to 15% by mass of the inorganic powders and 0.2 to 1% by mass of water. When the amount of the inorganic powders is less than 5% by mass, the soldering preventive effect tends to be reduced, whereas when the amount of the inorganic powders exceeds 15% by mass, a problem concerning the soldering of a forging product tends to arise.

When the powder-containing oil type lubricant of the present invention is used in the high-pressure casting, it is preferably constituted of 85 to 97% by mass of the oil type lubricant, 0.8 to 8% by mass of the solubilizing agents, 1 to 5% by mass of the inorganic powders and 0.2 to 2% by mass of water. When the amount of the inorganic powders is less than 1% by mass, the soldering preventive effect tends to be reduced, whereas when the amount of the inorganic powders exceeds 5% by mass, a problem concerning the soldering of a casted product tends to arise.

When the powder-containing oil type lubricant of the present invention is used in the forging, it is preferably constituted of 83 to 95% by mass of the oil type lubricant, 0.8 to 8% by mass of the solubilizing agent, 3 to 7% by mass of the inorganic powders and 0.2 to 2% by mass of water. When the amount of the inorganic powders is less than 3% by mass, the soldering preventive effect is reduced, whereas when the amount of the inorganic powders exceeds 7% by mass, there is a tendency that a problem concerning the scratching of a forging product arises.

The powder-containing oil type lubricant of the present invention may be appropriately formulated with a dispersant for dispersing the inorganic powders efficiently and a lubricating additive for imparting lubricity according to the need.

Next, the second and third aspects of the present invention will be explained in more detail. The second aspect of the present invention relates to an electrostatic spray method in which the powder-containing oil type lubricant (the first aspect of the present invention) mentioned above is applied to a die by electrostatic spraying. It is preferable to use an electrostatic spray method using an electrostatic spray apparatus (the third aspect of the present invention) mentioned below. The powder-containing oil type lubricant according to the first aspect of the present invention easily produces the electrostatic effect by using the electrostatic spray apparatus according to the third aspect of the present invention. For this, a uniform and sufficient coated film can be formed on hidden parts, irregular parts or fine parts of the die by the so-called wraparound effect. Further, as is clear from the examples which will be mentioned later, the powder-containing oil type lubricant contains a powder and therefore, the coated film formed on the surface of the die stands to high-temperature and high-heavy-load condition, bringing about increased lubricity. Particularly, when an electrostatic spray gun is installed on a multi-axle robot which can be moved under electrical control, the effect of imparting static electricity to necessary parts is amplified.

The electrostatic spray apparatus which is the third aspect of the present invention is one used to practice the electrostatic spray method which is the second aspect of the present invention and is characterized by a structure including a static electricity imparting device and an electrostatic spray gun on a multi-axle robot. FIG. 1A is an explanatory view of the outline of the whole structure of the electrostatic spray apparatus and FIG. 1B is an enlarged view of a part of the apparatus for explaining the situation where the powder-containing oil type lubricant is applied from the electrostatic spray apparatus mounted on the robot. The fundamental structure of the electrostatic spray apparatus of the invention is common to the cases of using for any purpose of high-pressure casting, gravity/low-pressure casting and forging.

The details of the apparatus are shown in FIG. 1A and FIG. 1B. As shown in FIG. 1A, the electrostatic spray apparatus is provided with an electrostatic spray gun 1 having a spray nozzle with a corona discharge electrode (not shown) for applying a high voltage as high as 60 KV or more at the head of the gun, in the vicinity thereof, and an electrostatic controller 2 and a transformer 3 each connected electrically to the electrode of this electrostatic spray gun 1. In addition, the electrostatic spray apparatus is also provided with a forced liquid-delivering device 4 (including a tank for the powder-containing oil type lubricant, gear/pump and valve) that supplies the powder-containing oil type lubricant to the electrostatic spray gun 1, an air compressor 6 that supplies compressed air to the electrostatic spray gun 1 through a tube 5 and a power source 7 (AC200 V or 100 V) that drives the electrostatic controller 2. Further, the electrostatic controller 2 and the transformer 3 constitute the static electricity imparting device 8. Further, the electrostatic spray gun 1 is provided with an air spray and plural pneumatic flow control valves (not shown) relating to the delivery control of the powder-containing oil type lubricant. This electrostatic spray gun 1 is connected to an air control system 13 through an air tube. The transformer 3 controlled by the electrostatic controller 2 may be formed in the electrostatic spray gun 1 as a built-in type. High voltage from the transformer 3 is fed to the electrode of the electrostatic spray gun 1. The powder-containing oil type lubricant is fed to the electrostatic spray gun 1 by the forced liquid-delivering device 4 and atomized by spray air supplied from the spray nozzle attached to the electrostatic spray gun 1. The static electricity imparting device 8 acts when power is output from the power source 7. Moreover, pneumatic compressed air is supplied from the air control system 13 to the electrostatic spray gun 1. Further, the built-in flow control valve is opened to start air spraying. When the power from the power source 7 is stopped, the static electricity imparting device 8 stops and the flow control valve is closed to stop air spraying. It is so designed that the timing of spraying is linked with the timing of imparting static electricity. The atomized powder-containing oil type lubricant is applied to a die in a charged state by a high-voltage corona discharge phenomenon at a corona discharge electrode disposed in the vicinity of the spray nozzle. Further, the distance between the dies used for high-pressure casting and forging is short and it is necessary to decrease the size of the electrostatic spray gun 1. One of the characteristics of the present invention is that the transformer 3 is not formed in the electrostatic spray gun 1 but is separated out of the electrostatic spray gun 1 to thereby reduce the size of the gun body. Further, since the electrostatic spray gun 1 is small, it is light-weight and the operability of the robot, when the robot is mounted, is improved.

In the examples which will be explained later, an EAB 90 model (manufactured by Asahi Sunac Co., Ltd.) was used as the electrostatic spray gun. 1. Further, a BPS1600 model (manufactured by Asahi Sunac Co., Ltd.) was used as the electrostatic controller 2. An assembled body of a K-pump (0.5 $cm^3$) model (manufactured by Ransburg Co., Ltd.) and BHI62ST-18 model (manufactured by Oriental Motor Co., Ltd.) was used as the forced liquid delivery device 4.

As shown in FIG. 1B, the multi-axle robot 9 is installed in a die casting machine (not shown). The electrostatic spray gun 1 is set to the multi-axle robot 9 via a bracket 10. Oil droplets 11, which are atomized and negatively charged, are sprayed from the electrostatic spray gun 1 on a die 12 grounded as shown in FIG. 1B and applied.

As mentioned above, the electrostatic spray apparatus has a structure provided with the static electricity imparting device 8 including the electrostatic controller 2, the transformer 3 and the power source 7 and the electrostatic spray gun 1 installed on the multi-axle robot 9. With this structure, an electrostatic field is formed so as to wraparound the die 12 and therefore, the negatively charged oil droplets 11 are applied so as to be along the electrostatic field. Therefore, the powder-containing oil type lubricant can be applied to the positions (for example, the backside of the die) of the die to which the electrostatic spray gun 1 does not directly face.

EXAMPLES

The powder-containing oil type lubricants for non-ferrous metals will be explained in detail by way of examples and comparative examples. The invention is not limited to the following examples and may be embodied by modifying the structural elements without departing from the spirit of the invention. Further, various inventions can be made by proper combinations of plural structures disclosed in the examples. For example, several structural elements may be excluded from all structural elements shown in the examples. Moreover, the structural elements may be appropriate combined so as to form different embodiments.

(A) Production Method

First, 1/10 the predetermined amount of a solvent as a major component of the oil type lubricant was charged into a heatable stainless oven equipped with a stirrer. Next, a dispersible powder (Gallamite) was charged and the mixture was lightly stirred for 5 minutes. Then, non-dispersible powders were all poured into the mixture, which was then stirred for 10 minutes. Further, a solvent in an amount half the predetermined amount was poured into the mixture, which was then stirred for 10 minutes. Then, a lubricity additives and the remainder solvent were added in a predetermined amount to the mixture, which was then stirred and heated to 40° C. with stirring and then, stirred continuously for 10 minutes. A liquid obtained separately by mixing water with a solubilizing agent in advance was poured into the mixture, which was then stirred for 10 minutes with heating to 40° C. Finally, it was confirmed that no precipitation was produced.

(B) Compositions of Samples

Samples used in the examples have the following compositions.

Oil type lubricant: the fundamental composition of the oil type lubricant for explaining the present invention was following three types (oil type lubricants A, B and C), which have similar compositions to each other as shown in Table 1. However, the amounts of water, solubilizing agents and powders based on the oil type lubricant were appropriately changed according to the object of the test. Specific compositions are described in each item.

Water: tap water obtained from a water supply and having a hardness of about 30 is used. 0.4% by mass of water is used unless otherwise noted.

Solubilizing agent: a mixture of an alcohol type nonion, sorbitan monooleate and metal alkylbenzenesulfonate (calcium salt) which is commercially available from Takemoto Yushi Co., Ltd.) under the name of New Kalgen 140). This compound is used in an amount of 1.6% by mass unless otherwise noted.

Powder mixture: an equivalent mixture of 1 part of Gallamite (clay with an organic material adhered thereto by surface treatment, the clay having high dispersibility) manufactured by Sasan Clay Product, Inc., 1 part of talc manufactured by Nippon Talc Co., Ltd.) and 1 part of calcium carbonate manufactured by Sankyo Seifun Co., Ltd.) was mixed in an appropriate amount according to the object.

TABLE 1

| | | Oil Type Lubricant A | Oil Type Lubricant B | Oil Type Lubricant C |
|---|---|---|---|---|
| Main Object Of The Test | | High-Pressure Casting | Gravity Casting | Forging |
| Composition (Mass %) | Solvent *1 | 89 | 96.5 | 80.5 |
| | High-Viscosity Mineral Oil *2 | 5 | 1 | 5 |
| | Silicone Oil 1 *3 | 5 | 1 | 2 |
| | Silicone Oil 2 *4 | | | |
| | Vegetable Oil *5 | 0.5 | 1 | 5 |
| | Lubricity Additive 1 *6 | 0.5 | | 2 |
| | Lubricity Additive 2 *7 | | | 2 |
| | Lubricity Additive 3 *8 | | | 1.5 |
| | Dispersant *9 | | 0.5 | 2 |

In Table 1:

*1: Solvent: Trade name: Shellzol manufactured by Shell Chemical, TM: flash point 90° C.

*2: High-viscosity mineral oil: Trade name: Bright stock, manufactured by Japan energy Co., Ltd., viscosity: 32 mm/s (100° C.)

*3: Silicone oil 1: Trade name: Release agent TN, manufactured by Asahi Kasei Wakker Silicone Co., Ltd., intermediate molecular weight

*4: Silicone oil 2: Trade name: AK-10000, manufactured by Asahi Kasei Wakker Silicone Co., Ltd., (high molecular weight)

*5: Vegetable oil: Trade name: Rape Seed Oil, manufactured by Meito Yushi Kougyo Co., Ltd.

*6: Lubricity additive 1: Trade name: Sakura Lub 165, manufactured by ADEKA Corporation, organic molybdenum

*7: Lubricity additive 2: Trade name: GS-230, supplied by Kozakura Shokai Co., Ltd., sulfide

*8: Lubricity additive 3: Trade name: M7101, manufactured by Infineum Japan Ltd., Ca soap

*9: Dispersant: Trade name: EFKA-3778, manufactured by Wilber-Elis Co., Ltd., acryl copolymer (C) Measuring Method (C-1) Method of Measuring Electric Resistance This electric resistance was measured by an electrostatic tester (model: EM-III) manufactured by Asahi Sunac Co., Ltd. according to ASTM D5682. A sample (lubricant) having a volume of about 50 $cm^3$ was taken in a 100 $cm^3$ beaker to measure the electric resistance of the sample. In this case, because the pointer indicating the electric resistance is unstable in a range of high resistance values, an average of five measured values was calculated.

(C-2) Method of Measuring the Quantity of Adhesion (C-2-1) Adhesion Tester

Figure 2:
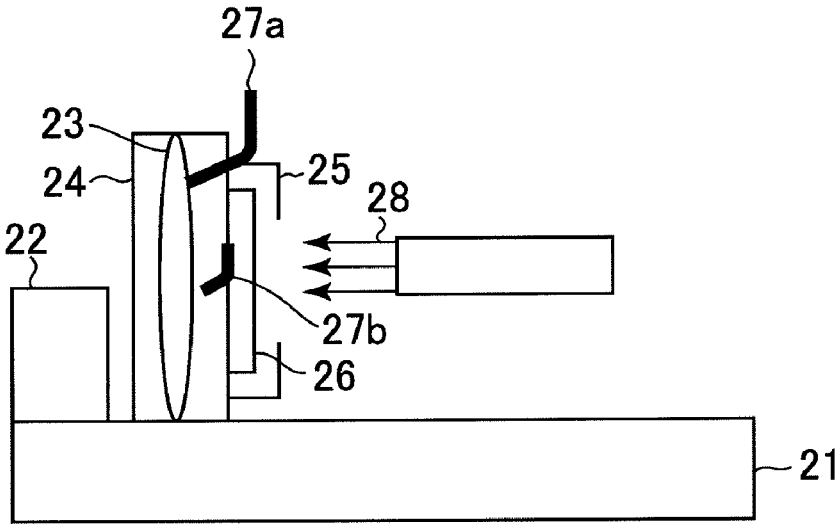
FIG. 2 is an explanatory view of a laboratory-type adhesion amount measuring tester for imitating the adhesion of an oil type lubricant in an actual die surface.

FIG. 2 shows a spray device for measuring the quantity of adhesion. A power source/temperature regulator 22 is installed on a table 21 of the adhesion tester. An iron trestle 24 having a built-in heater 23 is disposed on the table 21 in the vicinity of the power source/temperature regulator 22. An iron plate supporting fitment 25 is disposed on one side of the iron trestle 24 and a test piece (iron plate 26) is disposed inside of the iron plate supporting fitment 25. Thermocouples 27*a* and 27*b* are connected to the heater 23 and iron plate supporting fitment 25 respectively.

(C-2-2) Method of Measuring the Quantity of Adhesion

1. Preparation of a Test Piece

An iron plate 26 (100 mm square, 1 mm thickness) was baked at 200° C. for 30 minutes in an oven. Then, the iron plate was allowed to stand overnight in a desiccator to measure the mass of the iron plate to the order of 0.1 mg.

2. Lubricant Spraying Operation

First, the power source/temperature regulator 22 of the spray apparatus (manufactured by Yamaguchi Giken) as shown in FIG. 2 was set to the predetermined temperature and the iron plate supporting fitment 25 was heated by the heater 23. Here, when the thermocouple 27*a* reached the predetermined temperature, the iron plate 26 as the test piece was placed on the iron plate supporting fitment 25 to bring the thermocouple 27*b* into contact steadily with the iron plate 26. After that, when the iron plate 26 reached the predetermined temperature, a predetermined amount of the lubricant 28 was supplied from the electrostatic spray gun and applied to the iron plate 26. After that, the iron plate 26 was taken out and stood vertically in the air for a fixed time to allow it to cool, thereby squeezing away the oil falling from the iron plate 26. The spray conditions were as follows: temperature of the iron plate: 250° C., amount of the lubricant to be sprayed: 0.3 $cm^3$/time, distance between the iron plate and the head of the spray nozzle: 200 mm.

3. Measurement of the Quantity of Adhesion

The iron plate 26 with an adhesive material was placed in an oven kept at 105° C. for 30 minutes and then taken out. Then, the iron plate 26 was allowed to cool for a fixed time in a desiccator. After that, the iron plate 26 with an adhesive material adhered thereto was measured with a precision of the order of 0.1 mg, to calculate the quantity of adhesion from a variation in weight before and after the test.

(C-3) Method of Measuring Frictional Force

Figure 3:
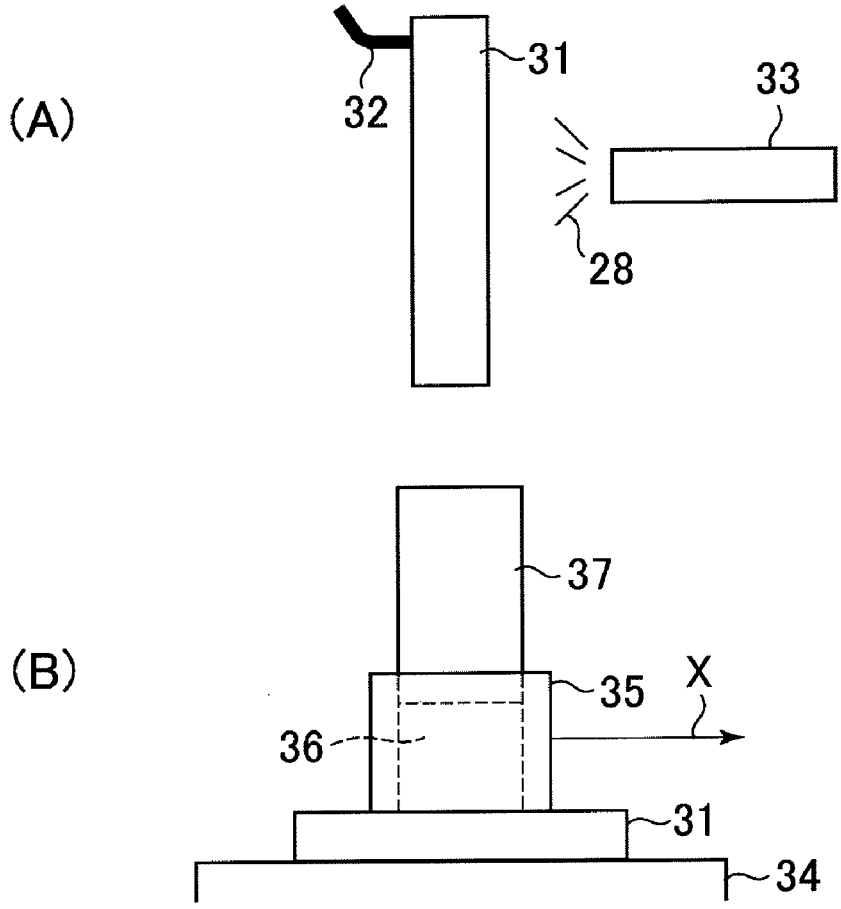
FIG. 3 is an explanatory view of a laboratory-type friction tester for estimating the frictional force required to take out an aluminum product solidified in an actual die.

Using a friction tester shown in FIG. 3 which had a good correlation with a high-pressure casting actual machine, frictional force was measured. When the measured value is 98 N or less, this level was considered to be no problem at all in an actual machine even when a cast product is taken out. When the measured value exceeds the value, partial soldering occurs. Further, when the test piece showed soldering in this tester, the production will be stopped by soldering in an actual machine. FIG. 3A and FIG. 3B are views showing a method of measuring the frictional force of the test piece in the order of step. A method of operating the friction test using the friction tester shown in FIG. 3 is as follows. An iron plate 31 (SKD-61, 200 mm×200 mm×34 mm) for measuring friction in an automatic tension tester (trade name: Lub Tester U) manufactured by MEC International Co., Ltd. is provided with a built-in thermocouple 32 as shown in FIG. 3A. The iron plate 31 is heated by a commercially available heater. When this thermocouple indicates the predetermined temperature, the iron plate 31 for measuring friction is made to stand vertically. The lubricant 28 through the spray nozzle 33 is then sprayed to the iron plate 31 in the same conditions as in the adhesion test. The iron plate 31 for measuring friction is horizontally placed on the tester trestle 34 as shown in FIG. 3B, that is, in such a manner that the spray surface faces upward immediately after the spraying. Further, a ring 35 (S45C, inner diameter: 75 mm, outer diameter: 100 mm, height: 50 mm) manufactured by MEC International Co., Ltd. is placed on the center of the iron plate 31 for measuring friction. In succession, 90 $cm^3$ of molten aluminum 36 (ADC-12, temperature: 670° C.), which has been melted in advance and reserved in a fusion furnace for ceramic art, is poured within the ring 35. After that, the molten aluminum 36 is allowed to cool for 40 seconds for solidification. Moreover, an 8.8 kg iron weight 37 is gently placed on the solidified aluminum (ADC-12) and then, the ring 35 is pulled in the direction of the arrow X by the gear of the tester to thereby measure the frictional force by a built-in strain gage.

(C-4) Method of Measuring Leidenfrost's Temperature

An iron plate to be used in the adhesion test is placed on a commercially available electric hot plate and then heated. Next, the surface temperature of the iron plate is measured by a non-contact type temperature gage. In succession, one liquid droplet (about 0.1 $cm^3$) of the lubricant is dropped from a pipette when the surface temperature reaches to 400° C. Immediately after the liquid droplet is dropped, the condition of the liquid droplet is observed to carry out the following procedures 1) to 3).

1) When the droplet is rolled or moved, the surface temperature of the iron plate is raised by 10° C. to retry the test.

2) When the droplet jumps, the surface temperature is dropped by 10° C. to retry the test.

3) In a certain temperature, the droplet boils mildly as in the situation between the above 1) and 2). This temperature is determined as the Leidenfrost's temperature.

(C-5) Measurement of Heat Transfer Coefficient

A metal test piece (10 mm in length, 2 mm in thickness) having a button cell form was arranged in the center of the test piece (100 mm square) of the adhesion tester, and a magnet was applied to the backside of the test piece to secure the metal test piece for measuring heat transfer coefficient. In order to form a spray film to the metal test piece, the spraying operation of the adhesion test was carried out in the following spray condition: temperature: 250° C., quantity of spray: 0.3 $cm^3$/time, spraying distance: 200 mm. As the lubricant, one obtained by mixing 9% by mass of a powder in the oil type lubricant B shown in Table 1 was used and the film thickness was adjusted by changing the number of sprayings. Then, a temperature measuring thermocouple was welded to the backside of the metal test piece. This metal test piece was set to a heat transfer coefficient measuring device (model: TC-7000) using the laser/flash method and manufactured by Ulvac-Riko Inc. The specific heat and thermal diffusivity were measured to calculate the heat transfer coefficient from the values of specific heat and thermal diffusivity and the density of the test piece measured in advance. Each sample was measured three times to calculate an average as the value to be measured.

(C-6) Measurement of Molten Metal Flow (C-6-1) Molten Metal Flow Tester

Figure 5:
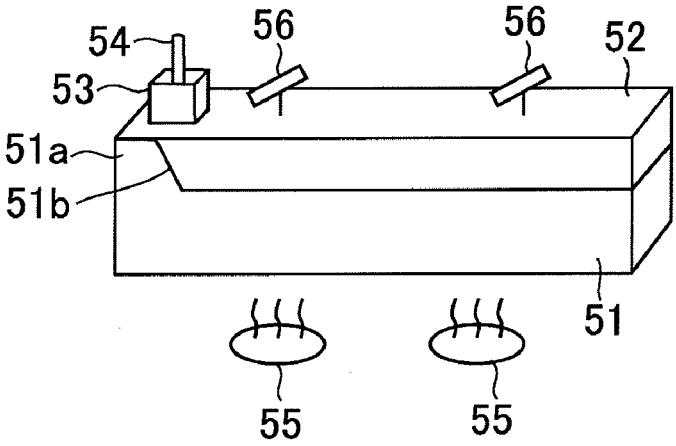
FIG. 5 is a whole view of a molten aluminum flow tester for measuring the distance of the flow of molten aluminum until it is solidified.
Figure 6:
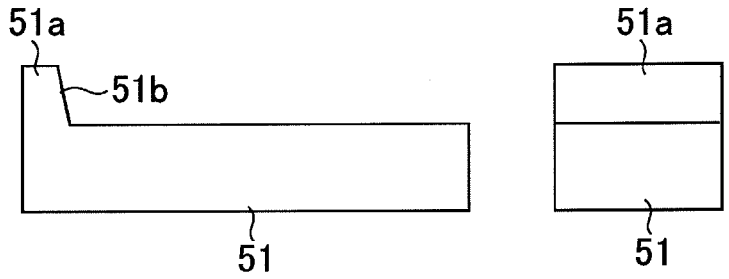
FIG. 6 is a view showing the side surface of a table constituting the molten metal flow tester shown in FIG. 5.
Figure 7:
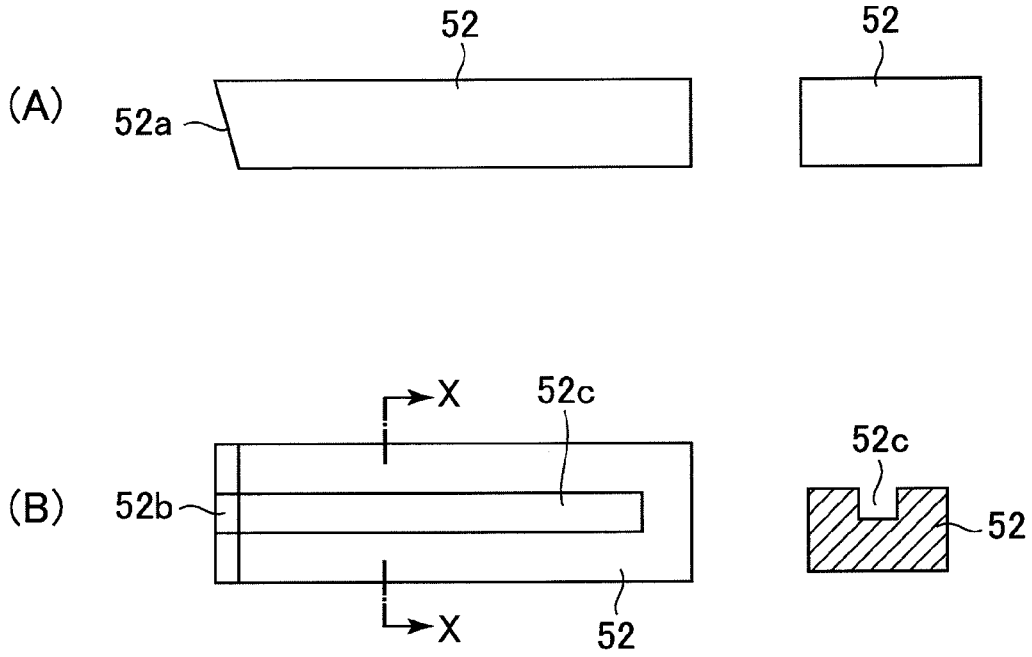
FIG. 7 is a view showing the lid constituting the molten metal flow tester shown in FIG. 5.
Figure 8:
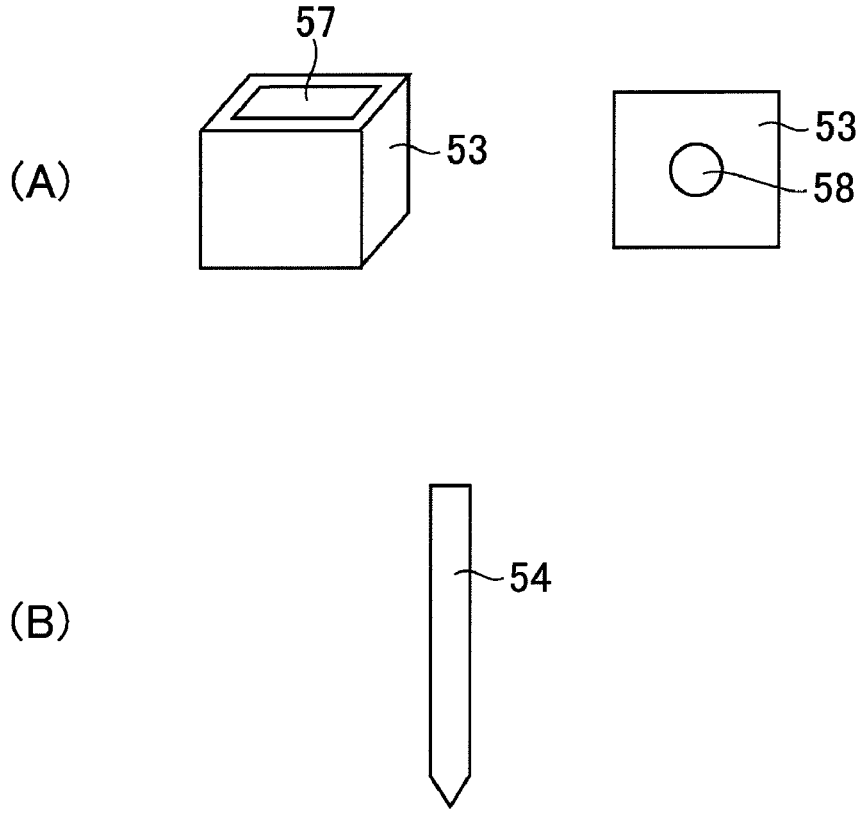
FIG. 8 is a view showing a measure and a bar to be used in a molten metal flow test using the molten metal flow tester shown in FIG. 5.

FIG. 5 to FIG. 8 are views of an iron made "molten metal flow tester" used in the examples of the present invention. FIG. 5 is a schematic view of a molten metal flow tester after each part of the molten metal flow tester is fabricated. FIG. 6 is a side view of a table 51 of the molten metal flow tester. FIG. 7A is a side view of a lid 52 of the molten metal flow tester and FIG. 7B is a backside view of the lid of the molten metal flow tester. As shown in FIG. 5, the molten metal flow tester is constituted of an iron table 51, an iron lid 52 mounted on the table 51, an isolite measure 53 mounted on the lid 52, a bar 54, a gas burner 55 and a handle 56. The table 51 is, as shown in FIG. 6, is provided with a project part 51*a* projecting upward at one end of the table 51 along the longitudinal direction and a slanting surface 51*b* is formed on the project part 51*a*. As shown in FIG. 7A, a slanting surface 52*a* is formed on the lid 52 as the part which is to be in contact with the slanting surface 51*b* when the lid 52 is mounted on the table 51. As shown in FIG. 7B, a pouring hole 52*b* and a groove 52*c* (20 mm in width, 2.5 mm in height) which is communicated with the pouring hole 52*b* to allow molten aluminum to flow therein are engraved on the slanting surface 52*a* of the lid 52. FIG. 8A is a view of the isolite measure 53 into which the molten aluminum is cast and the measure 53 is provided with an opening part 57 that casts the molten aluminum into the measure 53 and a 10 mm hole 58 communicated with the pouring hole 52*b* disposed on the bottom thereof. FIG. 8B is the isolite bar 54 which is a plug that temporality reserves the molten aluminum.

(C-6-2) Test Method of Molten Metal Flow

The operation of the molten metal flow test in FIG. 5 is as follows. First, the iron table 51 and the lid 52 are placed separately on the gas burner 55 and heated up to the predetermined temperature (350° C.). Further, the measure 53 and the bar 54 are heated to a temperature close to 500° C. by another burner. When the table 51 and the lid 52 reach the predetermined temperature, a lubricant is applied to the groove 52*c* of the lid 52 and the lid 52 is mounted on the table 51 by gripping the handle 56 of the lid. The measure 53 is placed on the lid 52 such that the pouring hole 52*b* of the lid 52 and the hole 58 of the measure 53 are communicated with each other to stop the hole 58 with the bar 54. Separately, 90 $cm^3$ of the molten aluminum (AC4CH material, temperature; 700° C.) is collected by an iron ladle and immediately poured into the measure 53. After 5 seconds, the hole is unplugged by the bar 54 to allow the molten aluminum to flow. After 30 seconds, the lid 52 is dismounted to measure the length of aluminum solidified on the table 51. It is determined that the molten metal flow characteristics are better with increase in the length of the flow of aluminum.

(C-7) Measurement of a Film Thickness (C-7-1) Film Thickness-Measuring Method-1: Non-Contact Type Using an infrared optical microscope (model VK-9500) manufactured KEYENCE Corporation, the film thickness of the coated film mainly constituted of a powder on the iron plate is measured. Basically, the operation is the same as in the case of a microscope. When the film thickness of the coated film is measured, a heat resistant glass fiber-containing tape is applied to the center of the iron plate 26 (see (C-2-2)) used for adhesion test to apply the powder-containing lubricant to the iron plate 26. When the film thickness is measured, a difference in level is formed between the coated film and the metal of the test piece if the tape is gently peeled off. This difference in level is measured as the film thickness. The range of measurement is 1 to 500 μm.

(C-7-2) Film Thickness-Measuring Method-2: Contact Type

This is an electromagnetic film thickness meter (LE-300J-model) manufactured by Kett Electric Laboratory, in which the measuring range is 5 to 500 μm. Since this is a contact type, there is the possibility that the true film thickness cannot be measured due to the pressure in the measurement and therefore, the measured value calibrated by a non-contact type optical microscope is used. On the other hand, this thickness meter is the advantage that it is mobile and it is therefore possible to measure the film thickness of even a test piece (for example, a test piece obtained by the molten metal flow test (C-6)) so large that it cannot be mounted on a microscope.

(C-8) Evaluation Test of Moldability (C-8-1) Moldability Evaluation Tester

Figure 9:
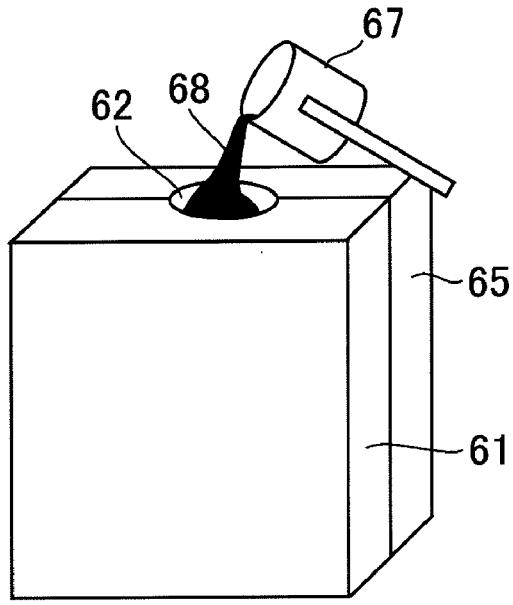
FIG. 9 is a schematic view of a moldability evaluation tester imitated from an actual gravity casting apparatus.
Figure 10:
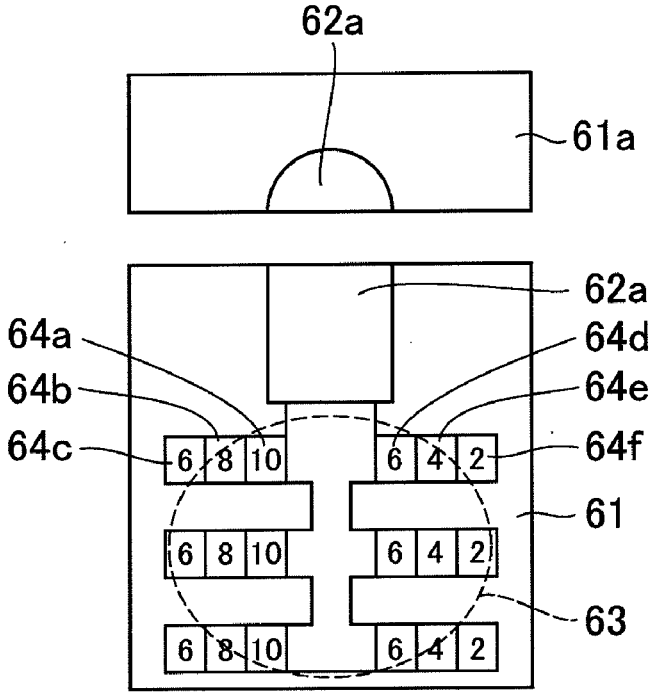
FIG. 10 is a view showing the detail of the left mold constituting the moldability evaluation tester shown in FIG. 9.
Figure 11:
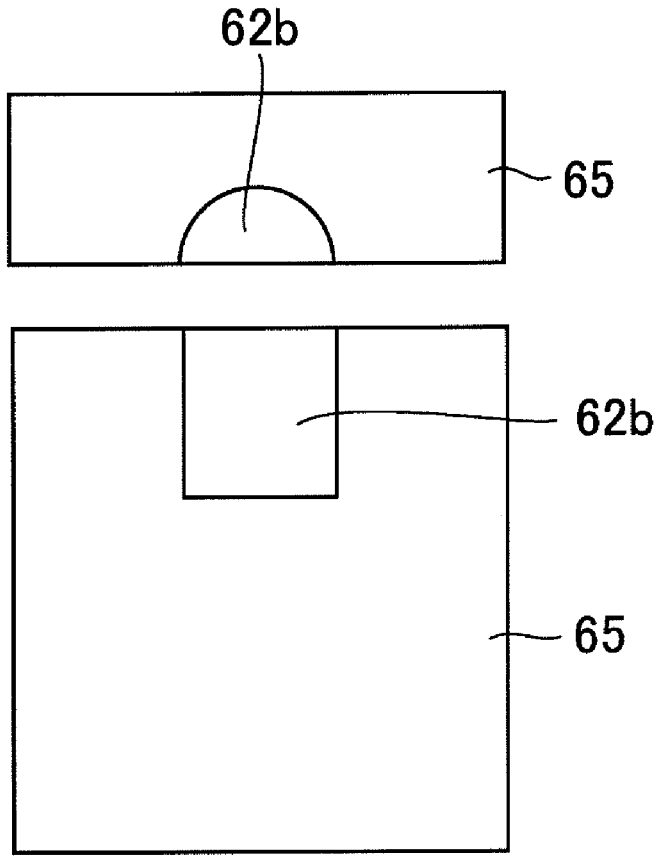
FIG. 11 is a view showing the detail of the right mold constituting the moldability evaluation tester shown in FIG. 9.
Figure 12:
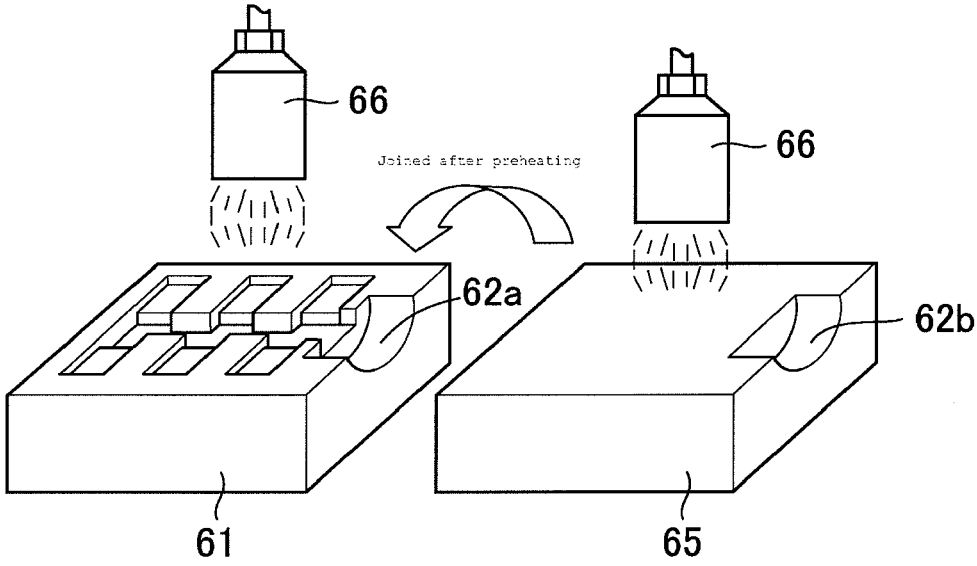
FIG. 12 is a view for explaining the operation of a moldability evaluation tester.
Figure 13:
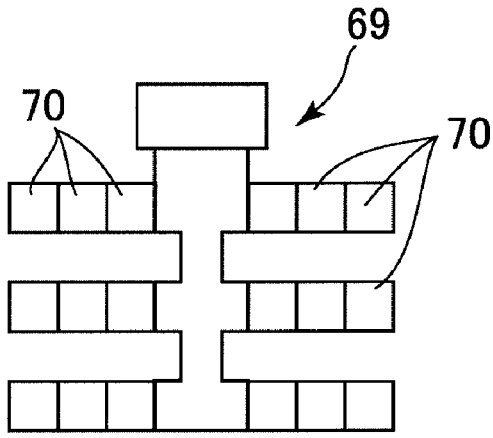
FIG. 13 is a view showing a casting product solidified by a moldability evaluation tester.
Figure 13:
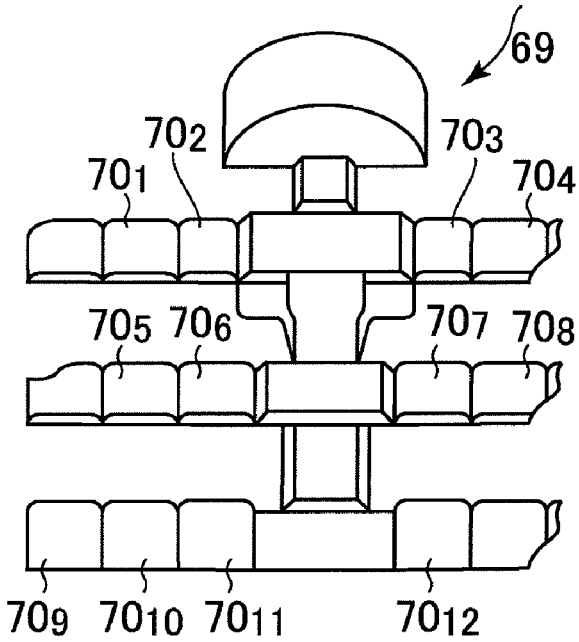

FIG. 9 to FIG. 13 are views showing a moldability evaluation tester imitating a mold for gravity casting used in the examples of the present invention, making it possible to evaluate not only the molten metal flow characteristics evaluated by the moldability tester of FIG. 5, but also the flowing of the molten metal into parts thin in thickness. FIG. 9 is schematic views of the moldability evaluation tester and the iron ladle 67 to be used in the moldability evaluation test. The moldability evaluation tester is made of iron and used by combining a left side mold 61 and a right side mold 65. FIG. 10 is a detailed view showing the upper surface and inside surface of the left side mold 61. FIG. 11 is a detailed view showing the upper surface and inside surface of the right side mold 65. Further, FIG. 12 is a view for explaining the operation of the moldability evaluation test using the moldability evaluation tester.

In the left side mold 61, as shown in FIG. 10, a semicircular notch 62*a* for forming a sprue 62 for flowing molten aluminum and a cavity part 63 having a product shape and communicated with the notch 62*a* are engraved. The cavity part 63 is divided into three branches in each of right and left directions like the form of ribs, and constituted of a total of 18 cells 64. The numerals in the cell 64 show the thickness of each cell, and these cells are different in thickness from each other. For example, the thicknesses of the cells 64*a*, 64*b* and 64*c* are 10 mm, 8 mm and 6 mm, respectively, and the thicknesses of the cells 64*d*, 64*e* and 64*f* are 6 mm, 4 mm and 2 mm, respectively. As shown in FIG. 11, the right mold 65 is provided with a semicircular notch 62*b* and the notch 62*a* of the left side mold is, as shown in FIG. 9, combined with the notch 62*b* of the right side mold 65 to thereby constitute the sprue 62.

(C-8-2) Evaluation Method

The operation of the moldability evaluation test is as follows. First of all, as shown in FIG. 12, the left side mold 61 and the right side mold 65 are heated to the predetermined temperatures separately by different gas burners 66. Next, a lubricant is applied to the left side mold 61 and the right side mold 65 and after several seconds, the left side mold 61 is combined with the right side mold 65 as shown in FIG. 9. Then, immediately, the molten aluminum 68 (AC4CH, 700° C.) is dipped out of the fusion furnace by the iron ladle 67 and poured (about 2.8 kg) into the molds from the sprue 62. After the molten aluminum was solidified (about 2 minutes), the left side mold 61 and the right side mold 65 are separated from each other to take out a cast product 69 (see FIGS. 13A and 13B) solidified by the left side mold 61. Finally, each cell is observed to find the number of cells having such a shape that the cavity is filled with aluminum. If the number of the parts 70 having a perfect shape is large, it is determined that the moldability is better and molten metal flow characteristics are better. On the other hand, if the number of parts 70 each having an imperfect shape like the parts 704 and 708 shown in FIG. 13B is large, it is determined that the molten metal flow is impaired.

(C-9) Measurement of Temperature

This temperature gage is a contact type temperature gage (HFT-40 type) manufactured by Anritsu Meter Co., Ltd. and the range of measurement is 200 to 1000° C. This temperature gage was used particularly for the measurement of surface temperature in the molten metal flow tester and friction tester.

(C-10) Ring Compression Test (C-10-1) Ring Compression Tester

Figure 14:
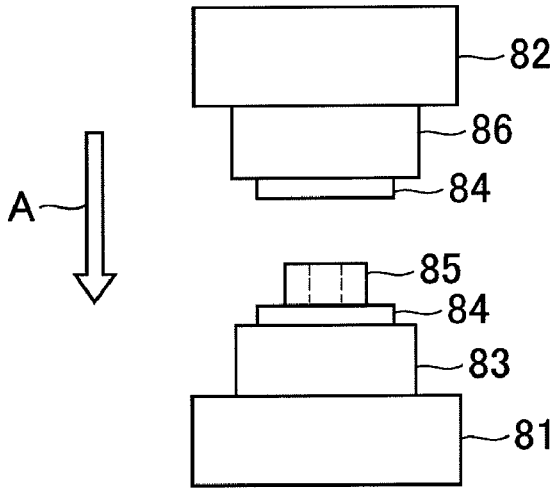
FIG. 14 is a view for schematically explaining the outline of a ring compression tester imitated from an actual forging.

FIG. 14 is a view for explaining the outline of a ring compression tester. The ring compression tester enables the measurement of the friction coefficient between solid aluminum and the lubricant when the solidified aluminum test piece is deformed under a heavy load. The ring compression tester is provided with a lower die set 81 and an upper die set 82. A die 83 is disposed on the lower die set 81 and the solid aluminum test piece 85 is disposed on the die 83 through a lubricant 84. A punch 86 is disposed on the backside of the upper die set 82 and the lubricant 84 is applied to the backside of the punch 86.

(C-10-2) Ring Compression Test Method

This test method for evaluating the friction under a heavy load is based on the ring compression test described in a reference (Plasticity and Processing, Vol. 18, No. 202, 1977-11) of Cold Forging Section Meeting-Warm Forging Research Group of the Japan Society for Technology of Plasticity. As to the outline of the test, the lubricant 84 is applied to the backside of the punch 86 secured to the upper die set 82. The lubricant 84 is applied to the die 83 secured to the lower die set 81 and the aluminum test piece 85 is then placed on the die 83. After that, pressure is applied in the direction of the arrow A to deform the aluminum test piece 85. The friction coefficient is read from the reduction ratio of the inside diameter of the deformed aluminum test piece 85.

(C-11) Evaluation of Forging Using an Actual Machine

Figure 15:
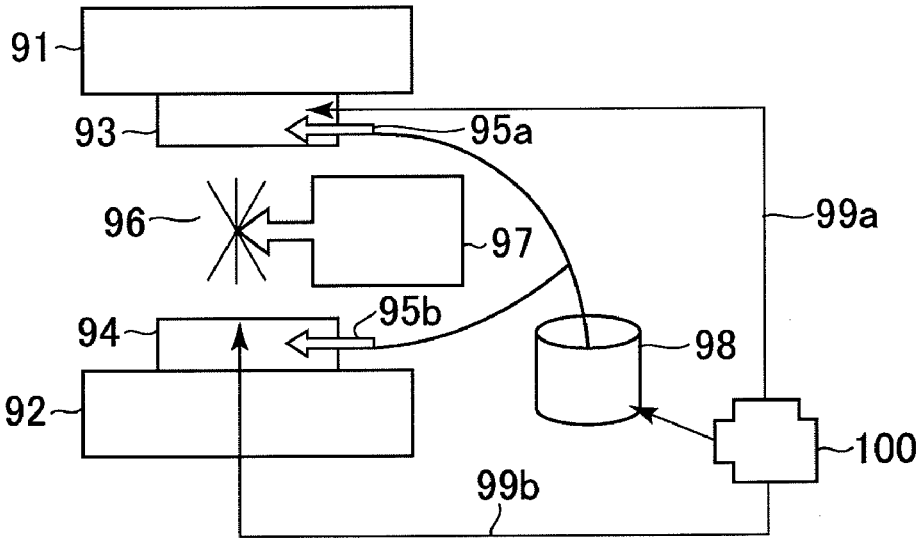
FIG. 15 is an explanatory view showing the situation where an electrostatic spray apparatus is experimentally mounted on an actual forging apparatus.

FIG. 15 is an explanatory view of the situation where an electrostatic spray apparatus is experimentally mounted on an actual forging machine. Using the actual machine shown in FIG. 15, the lubricity of the lubricant in the forging (melt down-bending molding) was evaluated. The actual forging machine is provided with an upper die set 91 and a lower die set 92 which are disposed opposite to each other, and an upper die 93 and a lower die 94 which are disposed inside of these die sets respectively. Cartridge heaters 95*a* and 95*b* are embedded in the upper and lower dies 93 and 94 respectively. An electrostatic spray gun 97 (delivery mechanism) that applies the lubricant 96 to the die electrostatically is disposed between the upper die 93 and the lower die 94 only during spraying. The cartridge heater 95*a* and 95*b* are electrically connected to a temperature rise unit 98 to thereby control the temperature. A temperature control unit 100 is electrically connected to thermocouples 99*a* and 99*b* embedded in the upper and lower dies 93 and 94 respectively. The lubricant 96 is applied to the upper and lower dies 93 and 94 from the electrostatic spray gun 97 incorporated into the robot. After that, a work is set to the lower die 94 and the upper die 93 descends to start forging. The forging was carried out in the following condition: temperature of the die: 250° C., load on the work: 2500 KN, temperature of the work: 470 to 490° C. and an aluminum round bar (about 10 cm (diameter)×50 cm) was used as the material of the work. The finished work had a size of about 50 cm×20 cm×2 cm. The rate of deformation was found from a variation in the position of the upper die set before and after forging.

(C-12) Method of Measuring the Viscosity

The dynamic viscosity at 40° C. was calculated from the absolute viscosity (cP) measured by a rotary viscometer according to JIS-K-7117-1 and the specific gravity.

(C-1) Method of Measuring the Flash Point

The flash point of a sample was measured by the Pensky-Martens method according to JIS-K-2265.

(D) Component and Test Results of Measurement (D-1) Formulation Enabling Electrostatic Spraying As mentioned above, the electric resistance of the oil type lubricant is infinite and therefore, the oil type lubricant is unsuitable to the electrostatic spraying. It has been found that the electric resistance can be reduced by dissolving water in the oil type lubricant. However, water is scarcely dissolved in the oil type lubricant mainly consisting of petroleum hydrocarbons and water separation can not be prevented without the aid of a solubilizing agent.

(D-1-1) Electric Resistance in the Case of Using a Mixture of Water and a Solubilizing Agent Under the fixed blending ratio (10% by mass) of the powder mixture in the oil type lubricant A, the optimum mixing ratio of water and solubilizing agent was checked by the measurement of electric resistance according to the measuring method described in (C-1).

As shown in Table 2, the electric resistance is infinite when the content of water is 0% by mass in Comparative Example 1 and Example 1. On the other hand, as shown in Examples 2 to 5 and Comparative Examples 2 to 4, the electric resistance is dropped in the tester if water is solubilized. If the electric resistance is higher, it is necessary to apply high voltage in an actual machine, whereas if the electric resistance is too low, the possibility of current leakage in an actual machine is increased. In the paint industries, it is said that an electric resistance of about 5 to 400 MΩis preferable from the viewpoint of performance and safety. However, the electric resistance is measured at a voltage of 1.5 V, and the measured values at 1.5V may have no correlation with that measured values at a voltage as high as 60 KV in an actual machine and therefore, the range is considered to be a rough criteria. It has been experimentally confirmed that a lubricant formulated with a polar lubricating additive can be used even in a wider range of electric resistance. On the other hand, though it is difficult to find because of dispersed powders, considerable haziness is observed when the content of water exceeds 8% by mass and the amount of the solubilizing agent exceeds 30% by mass. It is found from these facts that water is preferably in a range of 7.5% by mass or less and the solubilizing agent is preferably in a range from 0.3 to 30% by mass.

TABLE 2

| | Oil Type Lubricant A *1 (Mass %) | Powder Mixture *2 (Mass %) | Water *2 (Mass %) | Solubilizing Agent *2 (Mass %) | Electric Resistance (MΩ) |
|---|---|---|---|---|---|
| Comparative Example 1 | 90 | 10 | 0 | 0 | ∞ |
| Example 1 | 89.7 | 10 | 0 | 0.3 | ∞ |
| Example 2 | 89.6 | 10 | 0.1 | 0.3 | 1500 |
| Example 3 | 88 | 10 | 0.4 | 1.6 | 900 |
| Example 4 | 85 | 10 | 1 | 4 | 75 |
| Example 5 | 75 | 10 | 3 | 12 | 12 |
| Comparative Example 2 | 53 | 10 | 7.0 | 30 | 2.3 |
| Comparative Example 3 | 52 | 10 | 8.0 | 30 | 2.0 |
| Comparative Example 4 | 47 | 10 | 8.0 | 35 | 1.9 |

In Table 2;

*1: Oil type lubricant A: the same one as that shown in Table 1 is used.

*2: Water, the solubilizing agent and the powder mixture: those having "the composition of the sample (B)" are used.

(D-1-2) Electric Resistance when a Powder is Mixed

In (D-1-1), the optimum mixing ratio of water and solubilizing agent is mentioned under the condition of fixed amount of the powder in the oil type lubricant. In Examples 6 to 9 and Comparative Example 5 shown below, the amounts of water and the solubilizing agent are fixed (water: 0.2% by mass and solubilizing agent: 0.8% by mass) and the amount of the powder mixture is changed as shown in Table 3 to measure the electric resistance. The electric resistance was measured by the measuring method described in (C-1). As shown in Examples 6 to 9 of Table 3, the electric resistance in a 1.5 V tester was more increased than Comparative Example 5 with the increase of powder amount. However, as will be explained later, the electrostatic spraying of the powder-containing oil type lubricant at 60 KV was possible.

TABLE 3

| | Oil Type Lubricant A, Water, Solubilizing Agent *1, *2 (Mass %) | Powder Mixture *2 (Mass %) | Electric Resistance (MΩ) |
|---|---|---|---|
| Comparative Example 5 | 100 | 0 | 950 |
| Example 6 | 99 | 1 | 1000 |
| Example 7 | 95 | 5 | 1000 |
| Example 8 | 90 | 10 | 1500 |
| Example 9 | 85 | 15 | ∞ |

In Table 3;

*1: Oil type lubricant A: the same one as that shown in Table 1 is used.

*2: The powder mixture, water, and the solubilizing agent: the same composition as "composition of the sample (B)" is used.

(D-2) Influence of the Mixing of a Powder on Adhesion and Friction

The mixing of powders in the oil type lubricant makes it possible to control the bumping of the lubricant in a hot die and to improve the wettability of the die by the lubricant. As a result, the quantity of adhesion is increased, and therefore, the effect of "reducing friction and preventing soldering" can be expected. Further, soldering at high temperatures is prevented, the range of working temperature of the lubricant becomes wide and in addition, the coated film serves as an insulating material to reduce the drop in the temperature of the molten metal, making it possible to expect an improvement in "molten metal flow" because the inorganic powder is neither deteriorated nor decomposed even at high temperatures.

(D-2-1) Influence on LF Temperature

In order to examine the relation between the degree of bumping of the lubricant and the amount of the powder, the LF (Leiden frost's) temperature is examined by the test method described in (C-4). The results of the examination are shown in Table 4. This LF temperature was measured by using a sample obtained by mixing the powder mixture in the oil type lubricant A under the condition of no electrostatic spraying. Each sample of Comparative Examples 6 to 13 was controlled to have a composition in which the amounts of water and the solubilizing agent were fixed (water: 0.4% by mass and solubilizing agent: 1.6% by mass) and prepared by using the compositions as shown in Table 4.

TABLE 4

| | Oil Type Lubricant A, Water, Solubilizing Agent *1, *2 (Mass %) | Powder Mixture *2 (Mass %) | LF Temperature (° C.) |
|---|---|---|---|
| Comparative Example 6 | 100 | 0 | 440 |
| Comparative Example 7 | 99.9 | 0.1 | 450 |
| Comparative Example 8 | 99.7 | 0.3 | 460 |
| Comparative Example 9 | 99.0 | 1 | 460 |
| Comparative Example 10 | 97.0 | 3 | 500 |
| Comparative Example 11 | 95.0 | 5 | 510 |
| Comparative Example 12 | 90.0 | 10 | 510 |
| Comparative Example 13 | 85.0 | 15 | 510 |
| Water-Based Release Agent *3 | 0 | 0 | 240 |

In Table 4;

*1: Oil type lubricant A: the same one as that shown in Table 1 is used.

*2: The powder mixture, water and the solubilizing agent: the same composition as "composition of the sample (B)" is used.

*3: Water-soluble release agent: A liquid obtained by diluting A-201 (trade name), commercially available from Aoki Science Institute Co., Ltd., 40 times with water is used.

The LF temperature was 440° C. in Comparative Example 6 using no powder, whereas the LF temperatures in other Comparative Examples were increased in order of mention: Comparative Example 7 (powder=0.1% by mass, LF=450° C.), Comparative Example 8 (powder=0.3% by mass, LF=460° C.), Comparative Example 9 (powder=1% by mass, LF=460° C.), Comparative Example 10 (powder=3% by mass, LF=500° C.) and Comparative Example 11 (powder=5% by mass, LF=510° C.). Specifically, it is understood that when the amount of the powder to be mixed is increased, the bumping temperature is raised, which improves the wettability of the die by the lubricant. However, as shown in Comparative Example 12 (powder=10% by mass, LF=510° C.) and Comparative Example 13 (powder=15% by mass, LF=510° C.), the LF temperature is not so much raised and is 510° C. in both Comparative Examples even if the powder is increased more than above. From the facts, it is confirmed that the LF temperature is raised by adding the powder in the oil type lubricant. It is necessary to add the powder in an amount of 0.1% by mass or more to obtain the intended effect, but the effect of raising the LF temperature reaches the limit when the powder is mixed in an amount of about 5% by mass.

(D-2-2) Influence on the Quantity of Adhesion

When the LF temperature is raised by mixing the powder, an increase in the quantity of adhesion is also expected. In order to confirm this, the adhesion test was made by spraying the lubricant fed from a static electricity imparting device shown in FIG. 1 according to the test method described in (C-2) (hereinafter, in all cases of electrostatic spraying, the electrostatic spray apparatus of FIG. 1 is used to conduct the adhesion test). The test conditions were as follows: temperature of the iron plate: 250° C., air pressure: 0.05 MPa/cm$^2$, liquid pressure: 0.005 MPa/cm$^2$, spraying distance: 200 mm, quantity of spray: 0.3 cm$^3$. Here, the air pressure was 0.4 MPa/cm$^2$ because no electrostatic spray gun was used in the case of Comparative Example 14. Each sample of Examples 10 to 15 and Comparative Examples 14 to 18 was adjusted in the following manner. Specifically, a powder mixture shown in Table 5 was further mixed properly in a sample obtained by blending 0.4% by mass of water and 1.6% by mass of a solubilizing agent with the oil type lubricant A to be a total of 100% by mass.

TABLE 5

| | Powder Mixture *2 (Mass %) | Static Electrification (KV) | Quantity Of Adhesion (mg, 250° C.) | Frictional Force (N, 350° C.) | Frictional Force (N, 375° C.) | Frictional Force (N, 400° C.) | Frictional Force (N, 425° C.) |
|---|---|---|---|---|---|---|---|
| Comparative Example 14 *1 | 0 | 0 | 5.0 | Soldering | | | |
| Comparative Example 15 | 0 | 0 | 20.4 | 147.0 | Soldering | — | — |
| Comparative Example 16 | 0 | 60 | 25.1 | 147.0 | Soldering | — | — |
| Comparative Example 17 | 0.1 | 60 | 25.4 | 147.0 | Soldering | — | — |
| Example 10 | 0.3 | 60 | 25.6 | 156.8 | Soldering | — | — |
| Example 11 | 1 | 60 | — | 78.4 | Soldering | — | — |
| Comparative Example 18 | 3 | 0 | 31.3 | 58.8 | 58.8 | 68.6 | 78.4 |
| Example 12 | 3 | 60 | 34.7 | 58.8 | 58.8 | 58.8 | 68.6 |
| Example 13 | 5 | 60 | — | — | — | — | — |
| Example 14 | 10 | 60 | 49.9 | 39.2 | — | 68.6 | 68.6 |
| Example 15 | 15 | 60 | — | — | — | — | 68.6 |

TABLE 5-continued

| | Powder Mixture *2 (Mass %) | Static Electrification (KV) | Quantity Of Adhesion (mg, 250° C.) | Frictional Force (N, 350° C.) | Frictional Force (N, 375° C.) | Frictional Force (N, 400° C.) | Frictional Force (N, 425° C.) |
|---|---|---|---|---|---|---|---|
| Water-Based Release Agent *3 | 0 | 0 | 2.5 | Soldering | | | |

In Table 5;

*1: In the case of Comparative Example 14, not the electrostatic spray gun but the usual spray gun (Yamaguchi Giken) is used.

*2: A powder mixture is mixed in a formulation obtained by adding 0.4% by mass of water and 1.6% by mass of the solubilizing agent in the oil type lubricant A (using the same composition as the component (B)).

*3: The same one as that shown in Table 4 is used as the water-soluble release agent. In the case of the water-soluble release agent, soldering is caused around 275° C.

The following facts are understood from the results of Table 5.

1. Comparison with the Water-Soluble Release Agent

The quantity of adhesion of a water-based release agent, which occupies 90% of commercially available water-based release agents, is 2.5 mg. On the other hand, the quantity of adhesion of the oil type lubricant (all Comparative Examples and Examples) was 5.0 to 49.9 mg which is as much as 2 to 20 times that of the water-based release agent, and the soldering temperature was higher by about 80 to 150° C. As shown in Table 4, this is because the LF temperature is higher by 200° C. or more.

2. Adhesive Effect by the Electrostatic Spray Gun (no Static Electricity is Applied)

Comparative Example 15 (electrostatic spray gun, static electricity is not applied, containing no powder, quantity of adhesion: 20.4 mg) was more remarkably increased in the quantity of adhesion by 15.4 mg than Comparative Example 14 (usual non-electrostatic spray gun, static electricity is not applied, containing no powder, quantity of adhesion: 5.0 mg). Even if static electricity was not applied, the electrostatic spray gun itself was superior in, for example, spraying particle diameter and spraying pressure, leading to a remarkable increase in the quantity of adhesion.

3. Adhesive Effect by Static Electrification when no Powder is Blended

Comparative Example 16 (using the electrostatic spray gun, containing no powder, static electrification: 60 KV, quantity of adhesion: 25.1 mg) was more increased in the quantity of adhesion by 4.7 mg than Comparative Example 15 (using the electrostatic spray gun, containing no powder, static electrification: 0 KV, quantity of adhesion: 20.4 mg), showing that the adhesive efficiency was increased by as much as 23%. This result was obtained because lubricant mists charged by the electrostatic spray gun were adhered to the metal plate efficiently.

4. Adhesive Effect Obtained by Mixing the Powder when no Static Electricity is Applied As to the quantity of adhesion when a powder was mixed in the case of applying no static electricity was applied to the electrostatic spray gun, the quantity of adhesion was increased by 10.9 mg (increase in adhesion by 53%) as shown by the result of the comparison between Comparative Example 15 (powder: 0%, quantity of adhesion: 20.4 mg) and Comparative Example 18 (powder: 3% by mass, quantity of adhesion: 31.3 mg). When the powder is mixed, the LF temperature is raised and bumping is limited as explained in the aforementioned results of observation of the LF temperature. Specifically, since the bumping of the oil type lubricant on the vertical surface of the hot test piece is decreased, the amount of the oil type lubricant to be sprung from the surface of the test piece is reduced. As a result, the wettability of the test piece to the lubricant is improved, so that the adhesive efficiency is improved, with the result that the amount of the lubricant adhered to the test piece is increased.

5. Combination Effect of the Power Mixing and Static Electrification

In the case of applying static electricity, the quantity of adhesion was increased almost linearly in proportion to an increase in the amount of the powder in Comparative Example 17 (powder=0.1 mass %, quantity of adhesion=25.4 mg), Example 10 (powder=0.3 mass %, quantity of adhesion=25.6 mg), Example 12 (powder=3 mass %, quantity of adhesion=34.7 mg) and Example 14 (powder=10 mass %, quantity of adhesion=49.9 mg) as compared with those in Comparative Example 16 (powder=0 mass %, quantity of adhesion=25.1 mg).

The quantity of adhesion was significantly increased by the mixing of the powder and electrostatic spraying. As a result, a soldering preventive effect and the effect on a reduction in the amount of the lubricant to be applied are expected. In addition, when the coated film is formed on the surface of the die, the working range is expected to be widened.

(D-3) Influence of the Solvent in the Lubricant on the Electrostatic Spraying

The composition of each evaluation sample used above, as shown in Table 1, contains, as its major component, a solvent having a flash point of about 90° C. In the case of no powder is mixed and no static electricity is applied, a solvent is used in expectation of quick drying to increase the amount of the lubricant to be applied to the surface of the die. Specifically, the sprayed lubricant mists were dried quickly on the surface of the die to limit the deterioration in frictional force caused by a reduction in the thickness of the coated film based on the bleeding of the lubricant toward the lower part of the surface of the die.

On the other hand, such an effect was observed that the mixing of the powder and the electrostatic spraying increase the quantity of adhesion, increased the thickness of the coated film and reduced the frictional force. Therefore, in the present invention involving the mixing of the powder and the electrostatic spraying, there is the case where quick drying is not necessarily required. In order to confirm this point, the frictional force of the oil type lubricant containing, as its major component, a lubricant base oil (mineral oil) having a high flash point (reduced in quick drying characteristics) was evaluated in Comparative Examples 19 and 20. The frictional force was evaluated according to the test method described in (C-3). The conditions were as follows: quantity of spray: 0.3 $cm^3$, air pressure: 0.05 $MPa/cm^2$, spraying distance: 200 mm and static electricity was applied at 60 kV. The sample was based on Comparative Example 16 (electrostatic spraying type, containing no powder) and the solvent used in Comparative Example 16 was altered to base oil. The properties, compositions and results of the friction test of Comparative Examples 14, 16, 19 and 20 are shown in Table 6.

TABLE 6

| | | Comparative Example 16 *1 | Comparative Example 19 | Comparative Example 20 | Comparative Example 14 *1 |
|---|---|---|---|---|---|
| Properties | Flash Point (° C.) | 93 | 250 | 250 | 93 |
| | Viscosity (40° C., mm/s) | 2.5 | 55 | 100 | 2.5 |
| Composition (Mass %) | Solvent *4 | 87 | 0 | 0 | 87 |
| | Base Oil 1 *2 | 0 | 87 | 0 | 0 |
| | Base Oil 2 *3 | 0 | 0 | 87 | 0 |
| | High-Viscosity Mineral Oil *4 | 5 | 5 | 5 | 5 |
| | Silicone Oil 1 *4 | 5 | 5 | 5 | 5 |
| | Vegetable Oil *4 | 0.5 | 0.5 | 0.5 | 0.5 |
| | Lubricity Additive *4 | 0.5 | 0.5 | 0.5 | 0.5 |
| | Water *4 | 0.4 | 0.4 | 0.4 | 0.4 |
| | Solubilizing Agent *4 | 1.6 | 1.6 | 1.6 | 1.6 |
| Frictional Force (N) | 250° C. | 39.2 | 68.6 | 68.6 | 68.6 |
| | 300° C. | 58.8 | 59.8 | 88.2 | 78.4 |
| | 350° C. | 147 | 137.2 | Soldering | Soldering |
| Adhesion (250° C.) | Non-Electrostatic Spray Gun *5 | | | | 5 |
| | Electrostatic Spray Gun | 25.1 | | | |

In Table 6:

*1: Comparative Examples 14 and 16: Using the same ones as those described in Table 5.

*2: Base oil 1: NEXBASE 2008 (trade name) (flash point: 240° C.) commercially available from Showa Industrial Co., Ltd., Synthetic type lubricant base oil (PAO-8) of Group 4 in Classification of American Petroleum Institute.

*3: Base oil 2: N-500 (trade name) (flash point: 230° C.) commercially available from Japan Energy Corporation, Refined base oil of Group 1 in Classification of American Petroleum Institute.

*4: Components other than the base oils 1 and 2: the same one as the "composition of the sample (B)" and those described in Table 1.

*5: The same one as the usual gun mentioned in Table 5 is used as the non-electrostatic spray gun.

As mentioned above, the critical rating measured by the friction tester is 98 N. When the value is lower than 98 N, partial soldering does not occur whereas when the value exceeds 98 N, partial soldering occurs and it is determined that this is in a state just before a full soldering occurs. The rating of Comparative 16 (solvent is a main component) in Table 6 was 147 N at 350° C., showing that a partial soldering occurred and was in a state just before the full soldering. The rating of Comparative Example 19 (synthetic base oil is main component) was 137.2 N, which was almost not different from that of Comparative Example 16. The rating of Comparative Example 20 (refined base oil is a main component) was soldered at 350° C. However, to mention based on the experiences of the applicants of this case, there is not so much difference between the results of frictions forces "137.2 and 147 N". In the case of Comparative Example 16 and Comparative Example 19, it is estimated that soldering occurs at 355° C. On the other hand, from the results of Comparative Example 14 (usual gun) and Comparative Example 15 (electrostatic spray gun, applied static electricity is 0), the quantity of adhesion is increased about fourfold by using the electrostatic spray gun. It is considered from these results that the electrostatic spraying may be utilized to increase the thickness of the coated film or to widen the spray area.

Therefore, the deterioration in performance which is caused by compounding the base oil having a high flash point in place of a solvent can be amply covered by static electrification. The present invention is effective even in the case of using an oil type lubricant having a high flash point.

(D-4) Evaluation for Use in High-Pressure Casting (D-4-1) Adhesiveness/Frictional Force Test: Right-Angle Injection A soldering preventive effect can be expected by increasing the quantity of adhesion as mentioned above. The results of evaluation made using a friction tester having a high correlation with an actual machine according to the test method described in (C-3) are shown in Table 5. The spray condition of the test piece is the same as the adhesion test and the lubricant is injected at right angle. The following facts are clarified from the results of Table 5.

1. Adhesive Effect by Static Electrification

The frictional forces of Comparative Example 15 (static electrification=0) and Comparative Example 16 (static electrification=60 KV) were respectively 147 N at 350° C. showing that each of these examples was in a state just before it is soldered, and actually they were soldered at 375° C. Further, the frictional forces of Comparative Example 18 (powder=3 mass %, no static electrification) and Example 12 (powder=3 mass %, static electricity is applied at 60 KV) were the same and were not soldered at 425° C. or less. When the amount of the powder is the same, the soldering temperature was the same. Specifically, the effect on frictional force which effect was produced by the static electrification was not observed. As mentioned later, when the lubricant was applied to a die having an irregular surface in parallel, not at right angle, the frictional force reducing effect produced by static electrification is significantly observed. Further, in gravity casting, the frictional force reducing effect produced by static electrification is significantly observed.

2. Adhesive Effect by Blending of the Powder when no Static Electricity is Applied Comparative 18 (powder=3 mass %) exhibited a friction coefficient as low as 58.8 to 78.4 N at 425° C. as compared with Comparative Example 15 (powder=0 mass %, soldering at 375° C.). It is clear that the mixing of the powder contributes to a reduction in frictional force. It is inferred that the powder which is not deteriorated at high temperatures reduces direct contact between the iron plate and the solidified aluminum to thereby prevent soldering.

3. Effect of a Combination of Powder Mixing and Static Electrification

Example 11 (powder=1 mass %, 78.4 N at 350° C.) was slightly reduced in frictional force as compared with Comparative Example 16 (powder=0 mass %, 147 N at 350° C.). Further, the frictional force was reduced with increase in the amount of the powder to be mixed and the anti-soldering temperature was raised by as much as 50° C. as shown in Example 12 (powder: 3 mass %, 68.6 N at 425° C.), Example 14 (powder: 10 mass %, 68.6 N at 425° C.) and Example 15 (powder: 15 mass %, 68.6 N at 425° C.). However, when the amount of the powder was 3 mass % or more, the reduction effect of frictional force was not increased.

(D-4-2) Adhesive Characteristics/Frictional Force Test: Parallel Injection

There are parallel surfaces and hidden surfaces in the die as viewed from the direction of the spraying. Particularly, an ejector and core pins, at which soldering are easily occurred, have a columnar shape and there are therefore backsides to which spray mists are scarcely adhered. The electrostatic spraying can promote the adhesion of the oil type lubricant to such places.

Figure 4:
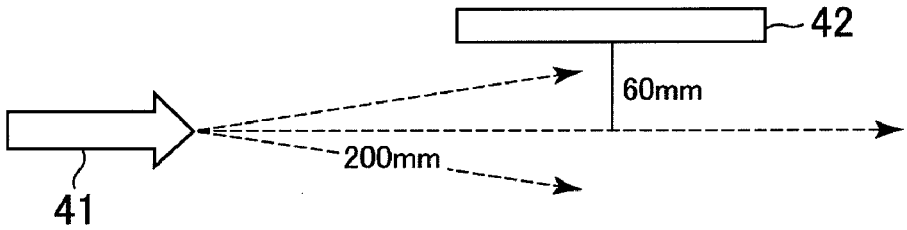
FIG. 4 is a view showing the layout for arranging a test piece in parallel to the direction of spraying in the case of confirming the electrostatic spraying effect.

In Example 16, as shown in FIG. 4, the oil type lubricant was applied to the test piece 42 in parallel to the test piece from the electrostatic spray gun 41 to measure the quantity of adhesion and frictional force. As to the situation where the test piece 42 was disposed, the offset position was made to be the center which was placed on the center line in the direction of the application of the oil type lubricant at a distance of 200 mm from the top of the electrostatic spray gun 41 and at a distance of 60 mm from the center line. The test piece 42 was disposed such that its center accorded to the offset position and the spray surface of the test piece was parallel to the direction of the spraying. A test piece for measuring the quantity of adhesion and a test piece for measuring frictional force were likewise disposed on the same position as above. The spray conditions were the same as in the case of the right-angle injection (Example 12) and specifically as follows: quantity of spray: 0.3 $cm^3$ and air pressure: 0.05 MPa/$cm^2$. Further, in Comparative Example 21, the quantity of adhesion and the frictional force were measured in the same manner as in Example 16 except that static electricity was not applied. The results of measurement of Examples 12 and 16 and Comparative Example 21 are shown in Table 7. The samples for evaluation of Examples 12 and 16 and Comparative Example 21 respectively have a composition obtained by mixing 0.4% by mass of water, 1.6% by mass of a solubilizing agent and 3% by mass of a powder mixture in the oil type lubricant A.

TABLE 7

| | Powder Mixture (Mass %) | Static Electrification (KV) | Direction Of Injection | Quantity Of Adhesion (mg, 250° C.) | Quantity Of Adhesion (mg, 300° C.) | Quantity Of Adhesion (mg, 350° C.) | Frictional Force (N, 350° C.) |
|---|---|---|---|---|---|---|---|
| Comparative Example 21 *1 | 3 | 0 | Parallel | 0.1 | 0.1 | 0.1 | Soldering |
| Example 16 *1 | 3 | 60 | Parallel | 4.5 | 3.9 | 3.4 | 68.6 |
| Example 12 *1 | 3 | 60 | Right Angle | 34.7 | — | — | 58.8 |

In Table 7:

*1: 0.4% by mass of water and 1.6% by mass of the solubilizing agent are added to the oil type lubricant A to make a base and a powder mixture is added in an amount of 3% by mass to the base, (using the same one as "the composition of sample (B)").

As shown in Table 7, the quantity of adhesion was 0.1 mg, which was almost 0, at a temperature range from 250° C. to 350° C. in Comparative Example 21 in which parallel spraying was performed by using an electrostatic spray gun without static electrification. For this, soldering was caused in Comparative Example 21 at 350° C. in the friction test. In Example 16 in which static electricity was applied, on the other hand, the quantity of adhesion was 4.5 mg at 250° C. and the frictional force at 350° C. was 68.6 N which was a sufficiently low level. This level stood comparison with the frictional force level (at 350° C.) of Example 12 in which the lubricant was injected at right angle. It is clear that the so-called wraparound phenomenon occurred that charged spray mists by static electrification were electrostatically attracted to the iron test piece. It is understood from this result that a coated film is formed even on an actual die having many irregularities on which the lubricants mists are not sprayed at right angle, making it possible to reduce the generation of soldering. It is to be noted that in the case of the water-soluble release agent which occupies 90% of the market, as mentioned above, the quantity of adhesion is about 2.5 mg at most even if the lubricant is injected at right angle. The quantity of adhesion in Example 16 in which the lubricant is injected in parallel when static electricity is applied is 4.5 mg, showing that the present invention is superior.

(D-4-3) Actual Machine Evaluation Using a High-Pressure Casting Machine

An increase in quantity of adhesion, increase in coated films and enlargement of the range of soldering preventive temperature were observed as the effect of the mixing of a powder and static electrification in the adhesion and friction tests when the lubricant is injected at right angle. Further, the lubricant mist wraparound phenomenon caused by static electrification was confirmed in the adhesion and friction tests when the lubricant is injected in parallel. Specifically, an excellent effect obtained by applying the powder-containing oil type lubricant, which is the first aspect of the present invention, by static electrification was confirmed experimentally. In light of this, in order to confirm the adhesion and soldering characteristics in an actual high-pressure die casting machine, the die casting machine owned by one of the applicants of this case was used to evaluate. The evaluation was made using a 2500 ton casting machine in the following evaluation conditions: maximum mold temperature just after spraying: 350° C., quantity of spray: 9 $cm^3$ and spray time: 20 seconds. The composition and results of evaluation of the samples are shown in Table 8 (Example 12, Comparative Examples 15-1, 15-2 and 18). The adhesion was evaluated by visual observation with a color dye contrast penetrant, (manufactured by Taseto CO., Ltd.) which was used to apply a white powder to whiten the whole surface of the die. After that, the oil type lubricant was applied and then, the white powder on the surface of the die was wetted with the oil type lubricant and changed to a blackish color. It was determined that a place changed in color to a blackish color was one to which the lubricant was adhered and a place which kept a white color was one to which no lubricant was adhered. Further, the soldering characteristics were determined based on whether or not the casting was made in practical production.

TABLE 8

| | | Comparative Example 15-1 *1 | Comparative Example 15-2 *1 | Comparative Example 18 *1 | Example 12 *1 |
|---|---|---|---|---|---|
| Composition (Mass %) | Oil Type Lubricant A, Water And Solubilizing Agent | 100 | 100 | 97 | 97 |
| | Powder Mixture | 0 | 0 | 3 | 3 |
| Electrostatic Spray Gun | | None *2 | Used | Used | Used |
| Static Electrification | | None | Present | None | Present |
| Evaluation Result-1, Degree Of Adhering | | 10% | Whole Surface | 20% | Whole Surface |
| Evaluation Result-2, Soldering Property | | Soldering | No Soldering | — | No Soldering |

In Table 8:

*1: mixing the powder mixture with the blending which 0.4% by mass of water and 1.6% by mass of a solubilizing agent are added to the oil type lubricant A (using the same one as "the composition of sample (B)"). *2: Using the usual gun described in *1 in Table 5.

As shown in Table 8, the ratio of the places to which the oil type lubricant was adhered was about 10 to 20% of the surface of the die in the case of applying no static electricity in Comparative Example 15-1 (containing no powder) and Comparative Example 18 (containing a powder) and was somewhat improved in the case of using an electrostatic spray gun. That is, the effect obtained by adding the powder was almost not observed. In the case of applying static electricity, on the other hand, in Comparative Example 15-2 (containing no powder) and Example 12 (containing the powder), the whole surface of the die was wetted. In other words, the existence of the powder has no influence on the wettability for the oil type lubricant but the static electrification has a large influence on an improvement in wettability. There are many irregularities on the surface of the die and it is therefore considered that the effect is resulted from the wraparound effect obtained by static electrification. In the case of Comparative Example 15-1 (usual gun), continuous casting could not be attained but the production was suspended when several products were produced. In the case of Comparative Example 15-2 and Example 12 in which the whole surface of the die was wetted, continuous production could be attained and the evaluation was stopped after 40 products were produced. Although the superiority of Example 12 to Comparative Example 15-2 owing to the powder was not observed in this evaluation, Example 12 using at least the powder-containing oil type lubricant did not give rise to any deposition problem by the powder on the die. Specifically, it was expected that a casting product was free from a lack of fill caused by the accumulation of the powder and it could be determined that no problem would arise. As shown in Table 5, a significant increase in adhesion was exhibited by the effects of a combination of the static electrification and mixing of the powder in the laboratory adhesion test. It is inferred from these results that in the case of Example 12 using an actual machine, the quantity of spray can be more reduced than that used in the case of Comparative Example 15-2.

(D-5) Gravity and Low-Pressure Casting

In gravity and low-pressure die casting processes, the pressure applied to push molten aluminum is designed to be lower than in the case of high-pressure die casting. For this, the speed of the molten aluminum is slow, the molten aluminum is cooled, the viscosity of the molten aluminum is increased and the molten aluminum is quickly solidified on the way. As a result, the problem easily arises that the molten aluminum is not flowed into every corner of the die. As shown in Table 5, it was found that the quantity of adhesion could be outstandingly increased by the blending of the powder and static electrification. If the quantity of adhesion is increased, the coated film on the die is thickened and it is therefore expected that the heat transfer from the molten aluminum to the die is reduced. As a result, a drop in the temperature of the molten aluminum is reduced and the molten aluminum is flowed smoothly. It is therefore expected that the molten aluminum is flowed into every corner of the die.

The oil type lubricant A used in Table 5 contains much high-viscosity oil and therefore, is easily carbonized on a casting product in the gravity casting in which the lubricant is in contact with the molten aluminum for a long time, giving rise to a coloring problem of a casted product. In order to solve this problem, the oil type lubricant B (low-viscosity oil containing less high-viscosity oil) was used as a base, and water, the solubilizing agents and the powder were mixed with the base. Then, a test was conducted to confirm that the quantity of adhesion was increased and soldering was reduced by the addition of the powder and static electrification.

(D-5-1) Effects of Powder Mixing and Static Electrification on Adhesion and Friction in the Case of Blending Low-Viscosity Oil Components Lubricants were prepared with the compositions shown in Table 9. The electrostatic spray gun was used to form a coated film in the following conditions: quantity of spray: 0.3 $cm^3$, spraying distance: 200 mm and air pressure: 0.05 $MPa/cm^2$. The test method described in (C-2) was used for the adhesion test and the method described in (C-3) was used for the friction test.

TABLE 9

| | | Comparative Example 22 | Comparative Example 23 | Comparative Example 24 | Example 17 |
|---|---|---|---|---|---|
| Composition (Mass %) | Oil Type Lubricant B *1 | 98 | 98 | 88 | 88 |
| | Powder Mixture *2 | 0 | 0 | 10 | 10 |

TABLE 9-continued

| | | Comparative Example 22 | Comparative Example 23 | Comparative Example 24 | Example 17 |
|---|---|---|---|---|---|
| | Water *2 | 0.4 | 0.4 | 0.4 | 0.4 |
| | Solubilizing Agent *2 | 1.6 | 1.6 | 1.6 | 1.6 |
| Static Electrification (KV) | | 0 | 60 | 0 | 60 |
| Test Results | Adhesion Test (mg, 250° C.) | 18.8 | 22.3 | 43.0 | 46.5 |
| | Friction Test (N, 375° C.) | Soldering | Soldering | 88.2 | 88.2 |
| | Friction Test (N, 400° C.) | Soldering | Soldering | Soldering | 88.2 |
| | Friction Test (N, 425° C.) | Soldering | Soldering | Soldering | 88.2 |

In Table 9

*1: Oil type lubricant B: the same one that is shown in Table 1 is used.

*2: Water, the solubilizing agent and the powder mixture: the same ones as those used in the "composition of the sample (B)" are used.

As shown in Table 9, Comparative Example 22 (powder=0 mass %, no static electrification) and Comparative Example 23 (powder=0 mass %, static electricity is applied) showed a soldering at 375° C. Further, Comparative Example 24 (powder=10 mass %, no static electrification) had a soldering at 400° C. though it did not show at 375° C. On the other hand, Example 17 (powder=10 mass %, static electricity is applied) did was not soldered at 425° C. or less. Therefore, in the case of the oil type lubricant slightly reduced in the content of high-viscosity components, the effects obtained by the mixing of the powder and static electrification according to the present invention were confirmed (as shown in Table 1, in the condition where the oil portion in the oil type lubricant A is 11 mass %, whereas the oil portion in the lubricant B is 3.5 mass %, the content of the powder is 10 mass % and static electricity is applied, the quantity of adhesion is 49.9 mg and 46.5 mg, showing that the effect of the lubricant B stands comparison with the effect of the lubricant A.).

(D-5-2) Influence of the Powder on Heat Conduction

As mentioned above, the amount of the lubricant adhered to the die is increased by the present invention. In light of this, the heat conductivity of the coated film was measured by the method described in (C-5). The thickness of the coated film was adjusted by varying the time of sprayings to one time, six times and 12 times. Besides the measurement of heat conductivity, a sample for the measurement of thickness was made by the same manners. The heat conductivity is an average of the values measured three times and this average was described collectively in Table 10. And the film thickness was measured by a contact type film thickness measuring device. Incidentally, the value measured by this contact type device was calibrated in advance by a noncontact type film thickness measuring device. The calibrated values are described in Table 10. Each sample of Examples 18 and Comparative Example 25 shown in Table 10 was prepared by using fixed amounts of water and solubilizing agent (water: 0.4 mass % and solubilizing agent: 1.6 mass %) according to the composition shown in Table 10.

TABLE 10

| Sample | Oil Type Lubricant B, Water, Solubilizing Agent *1, *2 (Mass %) | Powder Mixture *2 (Mass %) | Number Of Sprayings | Thickness Of Coated Film (μm) | Thermal Conductivity (W/cmK) |
|---|---|---|---|---|---|
| Blank *3 | None | None | 0 | 0 | 0.783 |
| Comparative Example 25 | 100 | 0 | 1 | 7 | 0.773 |
| Example 18 | 91 | 9 | 1 | 18.2 | 0.760 |

TABLE 10-continued

| Sample | Oil Type Lubricant B, Water, Solubilizing Agent *1, *2 (Mass %) | Powder Mixture *2 (Mass %) | Number Of Sprayings | Thickness Of Coated Film (μm) | Thermal Conductivity (W/cmK) |
|---|---|---|---|---|---|
| Example 18 | 91 | 9 | 6 | 103 | 0.519 |
| Example 18 | 91 | 9 | 12 | 216 | 0.295 |

In Table 10

*1: Oil type lubricant B: the same one that is shown in Table 1 is used.

*2: Water, solubilizing agent and powder mixture: the same ones as those used in the "composition of the sample (B)" are used.

*3: The heat conductivity was measured without using the lubricant.

The spray film of Example 18 (containing the powder) was thicker than that of Comparative Example 25 (containing no powder) in Table 10 (spraying: 1 time). Further, when the number of sprayings in Example 18 containing the powder was increased, the thickness of the spray film was increased to 18.2 μm (spraying: 1 time), 103 μm (spraying: 6 times) and 216 μm (spraying: 12 times) in proportion to the number of sprayings. The heat conductivity of the film was reduced corresponding to the thickness of the film as follows: the heat conductivity of the coated film of Comparative Example 25 was 0.773 W/cmK (film thickness: 7 μm) whereas the heat conductivity of the coated film of Example 18 was 0.295 W/cmK (film thickness: 216 μm). It was clarified that an increase in the thickness of the coated film brought about a reduction in heat conduction from the molten aluminum to the die. As a result, it can be expected that the drop in the temperature of the molten aluminum received in the die will be reduced, the temperature of the molten aluminum will be kept higher so that the viscosity of the molten aluminum is not increased and the distance of the molten metal flow will be large.

(D-5-3) Influence of the Powder on the Distance of the Molten Metal Flow

As mentioned above, it is expected that the reduction in heat conductivity brings about an increase in the distance of the molten metal flow. This fact was confirmed by using a molten metal flow tester shown in FIG. 5 according to the test method described in (C-6). The composition and spray condition of the sample and the results of the test are shown in Table 11.

TABLE 11

| | | Comparative Example 26 | Comparative Example 27 | Comparative Example 28 | Comparative Example 29 | Example 19 |
|---|---|---|---|---|---|---|
| Composition (Mass %) | Oil Type Lubricant B *1 | 98 | 87.5 | 87.5 | 77.5 | 87.5 |
| | Dispersant *3 | 0 | 0.5 | 0.5 | 0.5 | 0.5 |
| | Powder Mixture *3 | 0 | 10 | 10 | 20 | 10 |
| | Water *3 | 0.4 | 0.4 | 0.4 | 0.4 | 0.4 |
| | Solubilizing Agent *3 | 1.6 | 1.6 | 1.6 | 1.6 | 1.6 |
| Spray Condition (Mass %) | Presence Of Static Electrification | None | None | None | None | Present |
| | Spray Gun | Non-Electro-static Type *2 | Non-Electro-static Type *2 | Non-Electro-static Type *2 | Non-Electro-static Type *2 | Electro-static Type |
| | Quantity Of Spray ($cm^3$) | 50 | 50 | 100 | 50 | 100 |
| Test Results | Average Film Thickness (μm) | 10 | 40 | 71 | 138 | 111 |
| | Distance Of Molten Metal Flow (cm) | 5 | 28 | 37 | 50 | 50 |

In Table 11

*1: Oil type lubricant B: the same one that is shown in Table 1 is used.

*2: The same one as that shown in Table 5 is used as the non-electrostatic spray gun.

*3: The same ones as those used in the "composition of the sample (B)" are used as the dispersant, powder mixture, water and solubilizing agent. Dispersant, the powder mixture, water and the solubilizing agent: the same ones as those used in the "composition of the sample (B)" are used.

The test was made in the condition that in the case of Comparative Example 26 shown in Table 11, no powder was contained without any static electrification and in the case of Comparative Examples 27, 28 and 29, the powder is contained without any static electrification. Further, Example 19 was subjected to the test in the condition that the powder was contained and static electricity was applied. When comparing Comparative Examples 26, 27, 28 and 29 with each other, the thicknesses of the coated films were increased to 10 μm, 40 μm, 71 μm and 138 μm respectively when the amount of the powder to be mixed was increased from 0% by mass to 20% by mass. Accordingly, the distances of the molten metal flows were increased to 5, 28, 37 and 50 cm respectively.

As to current water-based mold coating agents used in actual machines, the initial film thickness is 100 to 150 μm. The molten metal flow rate in a laboratory tester using this water-based mold coating agent is about 35 cm. Taking this into consideration, it can be said that Comparative Example 28 (molten metal flow rate: 37 cm), in which the powder-containing oil type lubricant is applied not by electrostatic spraying, is satisfactory. In the case of Comparative Example 29, the powder was contained in a concentration as high as 20% by mass and therefore, the molten metal flow was evaluated in the condition of 50 $cm^3$ spray amount, which would correspond to 100 $cm^3$ of spray amount for an oil containing 10% by mass powder. As compared with the quantity of spray of 100 $cm^3$ in Comparative Example 28, the film thickness was increased from 71 μm to 111 μm and the distance of the molten metal flow was increased from 37 cm to 50 cm in Example 19 which corresponded to Comparative Example 28 in quantity of spray (Maximum length of the tester is 50 cm and a length exceeding this maximum length cannot be measured. The lengths of Comparative Example 29 and Example 19 may be "50 cm or more", but the molten metal flow characteristics of these examples are too good to measure).

It is clearly said that the molten metal flow characteristics were improved when the powder was contained and the coated film was formed by electrostatic spraying. It is inferred from the thickness of the coated film that in the case of Example 19, the molten metal flow (about 35 cm) of a water-based mold coating agent used in prior art technologies will be secured, provided that the quantity of spray is 50 to 60 $cm^3$. The electrostatic spraying has the advantage that the quantity of spray can be reduced by half. As a result, excess coated film thickness is limited to thereby improve the cooling ability after the molten metal flows, and it is therefore expected that the cycle time required for obtaining one product is shortened. Namely, this electrostatic spraying also has the merit that excellent working efficiency can be obtained. In the case of the water-based mold coating agent, it takes time to dry the die to remove water almost all day and night. On the other hand, when the powder-containing oil type lubricant is used and the coated film is formed by electrostatic spraying, it takes several seconds to dry the die, leading to remarkably improved production efficiency.

(D-5-4) Practical Evaluation in a Molding Evaluation Machine Equivalent to a Gravity Casting Practical Machine As mentioned above, when the powder-containing oil type lubricant was applied by electrostatic spraying, the heat conductivity of the coated film was dropped and the distance of the molten metal flow was increased. In order to confirm this laboratory test result, the molding evaluation machine (large-sized tester, weight of the mold: about 500 Kg) shown in FIG. 9, which is close to a practical machine, was used to evaluate this lubricant according to the method explained in (C-8). In this case, the molten metal temperature was 680° C. and the temperature of the die was 200 to 250° C. The composition and spray condition of the sample and test results are shown in Table 12.

TABLE 12

| | Powder Mixture *1 (Mass %) | Static Electricity | Nozzle | Quantity Of Spray ($cm^3$) | Direction Of Spraying | Ratings |
|---|---|---|---|---|---|---|
| Comparative Example 30 | 0 | None | Usual Nozzle *2 | 6 | Right Angle | 3/18 |

TABLE 12-continued

| | Powder Mixture *1 (Mass %) | Static Electricity | Nozzle | Quantity Of Spray ($cm^3$) | Direction Of Spraying | Ratings |
|---|---|---|---|---|---|---|
| Comparative Example 31 | 6 | None | Usual Nozzle *2 | 6 | Right Angle | 8/18 |
| Comparative Example 32 | 10 | None | Electrostatic Spray Gun | 12 | Right Angle | 17/18 |
| Example 20 | 10 | Applied | Electrostatic Spray Gun | 12 | Right Angle | 18/18 |
| Comparative Example 33 | 10 | None | Electrostatic Spray Gun | 12 | Parallel | 7/18 |
| Example 21 | 10 | Applied | Electrostatic Spray Gun | 12 | Parallel | 11/18 |

In Table 12;

*1: This powder mixture was adjusted so that 0.4% by mass of water, 1.6% by mass of a solubilizing agent and a powder mixture were mixed in the oil type lubricant B (using the same one that is shown in Table 1) to be a total of 100% by mass as the powder mixture. The same ones as those described in the "composition of the sample (B)" are used as the water, solubilizing agent and powder mixture.

*2: Usual nozzle: the same one as that shown in Table 5 is used.

The rating of Comparative Example 30 (containing no powder, no static electrification) was 3/18 (only 3 cells among 18 cells allow molten metal to flow into the die). In the case of Comparative Example 31 (containing the powder, no static electrification), the rating was 8/18, which was still low in grade. In the case of Comparative Example 32 (no static electrification) in which the amount of the powder was increased and the quantity of spray was increased, the rating was 17/18, which showed a remarkable improvement in grade. In the case of Example 20 (using the powder-containing oil type lubricant, electrostatic spraying), on the other hand, the rating was 18/18, which was enough to confirm that the lubricant had a good performance. Further, the surface of the casting product was prettier in the case of containing the powder. It is inferred that since the powder was contained, a gap is formed between the coated film and the casting product and gas produced from an oil component in the coated film escapes from this gap, so that the porosity generation can be reduced, which results in prettier appearance.

In addition, the "electrostatic wraparound phenomenon" observed in the laboratory test was examined by a molding evaluation device equivalent to a practical machine. Parallel spraying in the case of applying no static electricity in Comparative Example 33 resulted in that the rating was as low as 7/18. In the case of Example 21 in which static electricity was parallelly applied, the rating was raised 11/18. The electrostatic wraparound phenomenon was also confirmed even in a large-scaled tester.

(D-6) Forging (D-6-1) Ring Compression Test

The surface pressure of the friction tester described in (C-3) was 0.023 MPa, and therefore, the superiority of the powder-containing oil type lubricant was confirmed under this condition. However, it is difficult to apply this superiority to the film strength in the forging process performed under a condition of a load as high as 10000 to 100000 times the surface pressure. In light of this, the ring compression tester (1290 MPa, surface pressure about 60000 times that of the friction tester) shown in FIG. 14 was used to evaluate the coefficient of friction under a heavy load. The method described in (C-10) was used as the test method. The test condition was as follows: compressibility: 60±2%, inside diameter of the ring: 30 mm, punch temperature: 175±20° C., work temperature: 450° C., and quantity of spray: 1.32 ml (20 $cm^3$/min, 0.33 $cm^3$/sec×2 sec, applied to two positions (upper and lower positions)). The composition of the test sample, spray condition and coefficient of friction, which is an average of values measured three times, is shown in Table 13.

TABLE 13

| | Powder Mixture (Mass %) | Static Electrification | Coefficient Of Friction |
|---|---|---|---|
| Comparative Example 34 | No Lubricant | None | 0.58 |
| Comparative Example 35 *1 | 10 | None | 0.327 |
| Example 22 *1 | 10 | Applied | 0.290 |

In Table 13;

*1: This powder mixture was adjusted so that 0.8% by mass of water, 3.2% by mass of a solubilizing agent and then a powder mixture were mixed in an oil type lubricant C (using the same one that is shown in Table 1) to be a total of 100% by mass. The same ones as those used in the "composition of the sample (B)" are used as the water, solubilizing agent and powder mixture.

Comparative Example 34 is the case of using no lubricant and therefore has a coefficient of friction as high as 0.58. On the other hand, Comparative Example 35 and Example 22 are respectively the case of applying the powder-containing oil type lubricant. The coefficient of friction of Comparative Example 35 utilizing no static electrification was 0.327, whereas the coefficient of friction of Example 22 utilizing static electrification was 0.290. A friction reduction effect obtained by static electrification was clearly observed and therefore, the superiority of the present invention was confirmed even under a heavy load.

(D-6-2) Evaluation of Forging Using a Practical Machine

Because the effect of the present invention was confirmed in the laboratory test (ring test) made under a heavy load as mentioned above, the effect of the present invention in the forging practical machine shown in FIG. 15 was examined. The condition of evaluation was as follows: maximum sliding distance in the melt down-bending molding: 50 mm, temperature of the die: 250° C., target load: 2500 KN, working temperature: 470 to 490° C. and material: A6061 alloy. Though the target load was 2500 KN, the actual load was 2670 KN. The spray conditions were as follows: injection rate: 0.5 $cm^3$/sec and spray time: 3 seconds, the quantity of spray being a total of 6 $cm^3$ because both the upper die and the lower die were sprayed. The composition of the sample, spray condition and measured rate of deformation of the product are shown in Table 14.

TABLE 14

| | Powder Mixture (Mass %) | Static Electrification | Quantity Of Spray ($cm^3$) | Rate Of Deformation (%) |
|---|---|---|---|---|
| Comparative Example 36 *2 | 0 | None | 60 | 72.7 |
| Comparative Example 37 *1 | 10 | None | 6 | 70.9 |
| Example 23 *1 | 10 | Applied | 6 | 72.4 |

In Table 14;

*1: Comparative Example 37 and Example 23: having the same compositions as Comparative Example 35 and Example 22 in Table 13. The sample was adjusted so that 0.8% by mass of water, 3.2% by mass of a solubilizing agent and a powder mixture were mixed in an oil type lubricant C (using the same one that is shown in Table 1) to be a total of 100% by mass. The same ones as those described in the "composition of the sample (B)" are used as the water, solubilizing agent and powder mixture.

*2: Comparative Example 36: 10 times diluted a water-based lubricant of White Lub (trade name, manufactured by Taihei Chemical Industrial Co., Ltd., water glass type)

The rate of deformation of Comparative Example 37 (powder-containing oil type lubricant/no static electrification) was 70.9% and the rate of deformation of Example 23 (powder-containing oil type lubricant/static electrification is utilized) was 72.4%. The effect of the electrostatic spraying was observed and accorded to the inference from the test using the ring compression tester.

However, the rate of deformation of Comparative Example 36 (commercially available water-based lubricant) is 72.7%, which is equal to that of Example 23. Though any merit of the present invention is not found in the point of the rate of deformation, a merit on working processes can be expected. As shown in Table 4, the LF temperature of a water-based release agent for casting is about 240° C., the water-based lubricant for forging which is used in Comparative Example 36 and has almost the same water content is estimated to be 240° C. On the other hand, the LF temperature of the oil type lubricant is 510° C. Specifically, in the case of the water-based lubricant for forging, the temperature of the die is set to about 180° C. to secure the quantity of adhesion at the site. When the temperature of the die is raised, the amount of the lubricant to be adhered to the die is reduced and the spray film is therefore thinned. In the case of the oil type lubricant, the amount of the lubricant to be adhered is not reduced even if the temperature of the die is raised to 100° C. or more, and therefore, the coated film is not made thin. Therefore, the heat transferred from the work can be reduced. There is such an empirical knowledge that if hot forging can be conducted at higher temperatures, the rate of deformation is more increased. Further, in the case of carrying out a multi-step process and using a water-based lubricant, the forging process involves a work reheating step to cover the drop in temperature. If the temperature of the die is raised by 100° C. from 250° C. to 350° C., the work reheating step is unnecessary, making it possible to shorten the time required for carrying out the production process and to reduce the investment cost. Further, in the case of the oil type lubricant reduced in the quantity of spray to 1/10 the quantity of spray required in the case of using the water-based lubricant, the cooling phenomenon does not almost occur and therefore the reheating step will be surely omitted. Moreover, the rise in the temperature of the die allows the work to be soft, thereby making possible to reduce the molding load. Therefore, the present invention has a merit on working processes.

(D-7) Conclusion of the Results of Measurement

The following facts have been clarified from the test results.

1) Formulation Enabling Electrostatic Spraying

"0 to 7.5% by mass of water and 0.3 to 30% by mass of a solubilizing agent" are mixed to prepare a powder-containing oil type lubricant, which enabling electrostatic spraying. As to the electric resistance, the formulation of a powder produces such an effect as to increase the electric resistance infinitely and the formulation of water produces such an effect as to decrease the electric resistance. Further, the solubilizing agent serves to dissolve water in the oil type lubricant. When applying voltage at a voltage as high as 60 KV in a practical machine, the quantity of adhesion was increased, even if the electric resistance in the case of applying voltage at 1.5 V was high as will be mentioned later. It is inferred that the existence of a polar lubricating additive in the oil type lubricant enables electrostatic spraying.

2) Influence of the Mixing of the Powder on Adhesion

The LF temperature when the content of the powder was 0% by mass was 440° C. and was increased to 510° C. by adding 5% by mass of the powder. Namely, the LF temperature of the oil type lubricant was raised by mixing the powder. The oil type lubricant is boiled slowly as the boiling lubricant components, which are boiled little by little from the projections of the powder, restrain the bumping of the lubricant. This effect is the same effect that is obtained by preventing the occurrence of a bumping phenomenon using zeolite in a chemical experiment. However, this effect is increased when the content of the powder is up to 5% and there is a tendency that the effect is not observed even if the content of the powder is further increased to an amount exceeding 5%.

The quantity of adhesion was increased only by mixing the powder under the condition that static electrification was not utilized. When 3% by mass of the powder was mixed in the oil type lubricant containing no powder, the quantity of adhesion in the adhesion tester was increased to 31.3 mg from 20.4 mg. This is the result from the limitation to the bumping of the lubricant on the vertical surface of the mold. Specifically, it is inferred that the wettability of the surface of the die to the lubricant was improved, so that mists of the oil type lubricant which were repelled on the surface of the die were decreased, leading to an increase in the quantity of adhesion.

The addition of static electrification more increased the quantity of adhesion. When the powder was mixed in amounts of 3% by mass and 10% by mass, the adhesion quantity levels were 34.7 mg and 49.9 mg respectively. These are very high level as compared with the adhesion quantity (2.5 mg) of water-based release agents, which occupy 90% of the release agents in the market, or the adhesion quantity (5 mg) of the oil type lubricant without electrostatic spraying. These are the data demonstrating the effect of the composition of the first aspect of the present invention.

The adhesion improvement effect of the electrostatic spray gun itself was also observed. The amount of the oil type lubricant to be adhered by "a usual gun" was 5.0 mg in the conditions of no powder and no static electrification application. On the other hand, the amount of the oil type lubricant to be adhered by "an electrostatic spray gun" was 20.4 mg. The electrostatic spray gun itself is improved technologically, so that it produces very high adhesive efficiency and constitutes a part of the effect relating to the apparatus according to the third aspect of the present invention.

In addition, as to the composition of the oil type lubricant of the first aspect of the present invention, it was clarified that it was not always necessary to add the solvent. In the condition that the electrostatic spraying is not used, it is necessary that the solvent adheres to the die to impart quick drying ability to the oil film, thereby forming a dry film quickly on the die. Specifically, the adhesive efficiency is improved by mixing a solvent. However, this adhesive efficiency can be compensated by the electrostatic spraying and therefore, the quick drying ability is not always necessary and there is therefore the case where no solvent may be added without any problem. In fact, even if the solvent was replaced with refined base oil or synthetic oil having a high viscosity, the same electrostatic adhesion as in the case of using the solvent was exhibited. Even lubricating base oil (mineral oil) of Fourth Class Petroleum (a flash point of 200° C. or more in the Fire Protective Law of Japan) may be used in the present invention.

3) Influence of the Formulation of the Powder on Friction

The soldering of the die was reduced by formulating the powder in the oil type lubricant. The frictional force at 350° C. with static electrification and without powder was 147N (just before soldered) while the frictional force with static electrification and 1% by mass of the powder was reduced to 78.4 N. Further, when 3% by mass of the powder was formulated, no soldering was observed even at 425° C. As compared with the soldering temperature (about 250° C.) in the case of using a water-based release agent and with the soldering temperature (350° C.) in the case of using the oil type lubricant containing no powder, the oil type lubricant of the present invention was not soldered at a temperature more higher than those temperatures and has a wider application. It can cover almost 100% of the working temperature range of high-pressure and high-speed die casting machines in the market.

However, when only the effect of electrostatic spraying was examined, almost no effect was observed in the case of injecting the lubricant at right angle when the powder was formulated. It is guessed that the resistance to soldering was sufficiently improved already by addition of the powder and therefore, the effect produced by the electrostatic spraying was not observed. In light of this, the "wraparound effect" of static electrification by parallel injection was examined, to find that significant effect of the static electrification was observed. When the oil type lubricant containing 3% by mass of the powder was applied by parallel injection to a test piece, the test piece was soldered at 350° C. in the condition without electrostatic spraying and the frictional force was 68.6 N in the condition with electrostatic spraying. At this time, the quantity of adhesion at 250° C. was 0.1 mg in the case of no electrostatic spraying, whereas the adhesion quantity was increased to 4.5 mg in the case of electrostatic spraying. This effect in this tester was also confirmed in a molding evaluation machine close to a practical machine. The effect of the composition according to the first aspect of the present invention and the effect of the spray method according to the second aspect of the present invention were confirmed.

4) Influence on the Mixing of the Powder on Insulating Ability

The heat conductivity of the coated film was significantly dropped. The heat conductivity was 0.773 W/cmK in the case of no coated film, whereas the heat conductivity was 0.285 W/cmK in the case of 216 μm of coated film. Because the film thickness is several μm in the case of high-pressure casting and several μm to ten and several μm in the case of forging, a significant reduction in heat conductivity cannot be expected. However, a film having a film thickness of 100 to 150 μm is formed in the case of gravity/low-pressure casting and therefore, this reduction in heat conductivity is effective.

In the molten metal flow test for gravity/low-pressure casting, the distance of molten metal flow was significantly increased from the reason that heat conductivity was reduced. The molten metal flow, which was 5 cm when the spray film thickness was 10 μm, was increased to 37 cm when the spray film thickness was 71 μm. Even in this case, the effect of the electrostatic spraying was observed. When electrostatic spraying was not carried out, the molten metal flow was 37 cm and the coated film thickness was 71 μm. On the other hand, when electrostatic spraying was carried out, the molten metal flow was 50 cm or more and the coated film thickness was 111 μm in the same spray condition.

5) Effects of the Powder Mixing and Static Electrification on Adhesion and Friction in the Case of Formulation Low-Viscosity Oil Components This is the studies made mainly for gravity/low-pressure casting using a large amount of the lubricant. The product after casting has a problem concerning the "color mark". This is a problem resulting from the carbonization of high-viscosity hydrocarbons. In light of this, studies were made as to a formulation decreased in oil content. The oil content was reduced, that is, the oil type lubricant B having an oil content of 3.5% by mass was used in place of the oil type lubricant A having an oil content of 11% by mass. However, the quantity of adhesion was 49.9 mg in the case of the oil type lubricant A and 46.5 mg in the case of the oil type lubricant B. In other words, the quantity of adhesions in both cases are almost the same regardless of oil content.

6) Friction Under Compression

A ring test was made under a heavy load as high as about 60000 times that of the laboratory friction tester. Using the powder-containing oil type lubricant, studies were made on the friction with and without electrostatic spraying. The coefficient of friction was decreased from 0.327 under the condition without static electrification to 0.290 with static electrification. Therefore, the effect of the electrostatic spraying under high compression was confirmed.

7) Effect in Practical Machines a) High-Pressure and High-Speed Die Casting

The wettability of the die surface to the sprayed lubricant was significantly improved by static electrification. It can be said that the wraparound effect was produced by electrostatic spraying. Because the whole die surface was wetted, on the other hand, the effect of the powder mixing was not clarified in this evaluation. Further, even if the powder was mixed, no soldering was generated in the practical machine and the actual production was continued 40 times until the evaluation was stopped. It is estimated from the laboratory test results in (D-4-1) and (D-4-2) that the quantity of spray is considered to be reduced in a practical machine.

b) Gravity Die Casting

In the molding ability evaluation tester simulating a practical machine, the ratings were higher in the case of containing the powder and static electrification and 100% of molten metal could be filled compared with the conditions of no powder and no static electrification. This was the result from the thickening of the coated film, improvement in insulation characteristics and better molten metal flow.

c) Forging

The friction reducing effect produced by the present invention was observed under a heavy load. Using the practical machine, this effect was confirmed. The rate of deformation in the case of containing the powder and no electrostatic spraying was 70.9% whereas the rate of deformation in the case of containing the powder and electrostatic spraying was 72.4%. In short, the rate of deformation was slightly improved. On the other hand, this rate of deformation was the same as that (72.7%) of a commercially available water-based lubricant. However, in the case of the present invention, the quantity of spray was as small as 1/10 that used in the case of using a water-based lubricant, and also, the LF temperature was high because the oil type lubricant was used. Therefore, the temperature of the die can be set to as high as 100° C. or more and the reheating process may be omitted. It can be expected that the production time is remarkably shortened.

8) Conclusion

As mentioned in 1) to 7), the following excellent effects were confirmed from the results of the various evaluations by applying the powder-containing oil type lubricant and electrostatic spraying.

1. The adhesion increase to the die by the powder-containing oil type lubricant: As compared with the case of containing no powder, the thickness of the coated film is more increased and the range of soldering is more narrowed even if the quantity of spray is the same. When no soldering is generated, the quantity of spray can be further reduced.

2. Soldering preventive effect: The temperature at which soldering occurs is 350° C. to 425° C. and the range of applications of the powder-containing oil type lubricant is more widened. Therefore, powder-containing oil type lubricant can be used effectively in high-pressure casting, gravity casting and forging.

3. Wraparound effect: electrostatic spraying ensures that the powder-containing oil type lubricant can be adhered even to hidden parts of a die having a complicated form and therefore, the range where the lubricant can be used is further widened. This lubricant can be efficiently used in high-pressure casting having a complicated form.

4. Insulation effect: The adhesion amount of the powder-containing oil type lubricant is increased and a thick coated film can be formed. Therefore, the insulation ability can be improved and molten metal flow characteristics can be improved. The powder-containing oil type lubricant can be used efficiently in gravity casting.

5. Shortening of drying time: Because powder-containing oil type lubricant is used, the drying time is shorter and specifically, several seconds than that in the case of using a water-based lubricant. Therefore, the powder-containing oil type lubricant can be used in gravity casting efficiently.

6. Adhesiveness at high temperatures: The temperature of the die can be raised, making it possible to omit the reheating process in the forging process. The powder-containing oil type lubricant can be used in forging efficiently.

The method, in which the powder-containing oil type lubricant of the present invention is applied by electrostatic spraying, is suitable for the casting and forging process of non-iron metals.

| EXPLANANTIONS OF REFERENCE NUMERALS | |
|---|---|
| 1 | electrostatic spray gun |
| 2 | electrostatic controller |
| 3 | transformer |
| 4 | forced liquid-delivering device |
| 5 | tube |
| 6 | air compressor |
| 7 | power source |
| 8 | static electricity imparting device |
| 9 | multi-axle robot |
| 10 | bracket |
| 11 | oil droplets |
| 12 | die |
| 13 | air control system |
| 21 | table |
| 22 | power source/temperature regulator |
| 23 | heater |
| 24 | iron trestle |
| 25 | iron plate supporting fitment |
| 26 | iron plate |
| 27 | thermocouple |
| 28 | lubricant |
| 31 | iron plate |
| 32 | thermocouple |
| 33 | spray nozzle |
| 34 | tester trestle |
| 35 | ring |
| 36 | molten aluminum |
| 37 | iron weight |
| 41 | electrostatic spray gun |
| 42 | test piece |
| 51 | table |
| 51a | project part |
| 51b | slanting surface |
| 52 | lid |
| 52a | slanting surface |
| 52b | pouring hole |
| 52c | groove |

-continued

| EXPLANANTIONS OF REFERENCE NUMERALS | |
|---|---|
| 53 | measure |
| 54 | bar |
| 55 | gas burner |
| 56 | handle |
| 57 | opening part |
| 58 | hole |
| 61 | left side mold |
| 62 | sprue |
| 62a | semicircular notch |
| 62b | semicircular notch |
| 63 | cavity part |
| 64 | cell |
| 65 | right side mold |
| 66 | gas burner |
| 67 | iron ladle |
| 68 | molten aluminum |
| 69 | cast product |
| 70 | part |
| 81 | lower die set |
| 82 | upper die set |
| 83 | die |
| 84 | lubricant |
| 85 | aluminum test piece |
| 86 | punch |
| 91 | upper die set |
| 92 | lower die set |
| 93 | upper die |
| 94 | lower die |
| 95a | cartridge heater |
| 95b | cartridge heater |
| 96 | lubricant |
| 97 | electrostatic spray gun |
| 98 | temperature rise unit |
| 99a | thermocouple |
| 99b | thermocouple |
| 100 | temperature control unit |

What is claimed is:

1. A powder-containing oil type lubricant for the die, the lubricant comprising 60 to 98.7% by mass of an oil based lubricant, 0.8 to 30% by mass of a solubilizing agent, 0.3 to 15% by mass of an inorganic powder and 0.2 to 7.5% by mass of water, wherein the powder-containing oil-based lubricant is capable of carrying an electric charge.

2. An electrostatic spray method of electrostatically applying the powder-containing oil type lubricant as claimed in claim 1, to the die.

3. The powder-containing oil-based lubricant according to claim 1 in combination with an electrostatic spray apparatus that electrostatically applies the powder-containing oil-based lubricant to the die, the apparatus being provided with a static electricity-imparting apparatus that imparts static electricity to the powder-containing oil-based lubricant and an electrostatic spray gun disposed on a multi-axis robot.

* * * * *

UNITED STATES PATENT AND TRADEMARK OFFICE

CERTIFICATE OF CORRECTION

PATENT NO. : 8,394,461 B2
APPLICATION NO. : 13/061742
DATED : March 12, 2013
INVENTOR(S) : H. Komatsubara et al.

It is certified that error appears in the above-identified patent and that said Letters Patent is hereby corrected as shown below:

In the Claims

At column 44, line 36 (claim 1, line 1) of the printed patent, “oil type” should be --oil-based--.

At column 44, line 36 (claim 1, line 1) of the printed patent, “the die” should be --a die--.

At column 44, line 43 (claim 2, line 2) of the printed patent, “oil type” should be --oil-based--.

Signed and Sealed this
Twenty-third Day of July, 2013

Teresa Stanek Rea
*Acting Director of the United States Patent and Trademark Office*